US008421679B2

(12) United States Patent
Suzuki et al.

(10) Patent No.: US 8,421,679 B2
(45) Date of Patent: Apr. 16, 2013

(54) ANTENNA DEVICE AND ANTENNA ELEMENT USED THEREFOR

(75) Inventors: Kei Suzuki, Tokyo (JP); Masaki Matsushima, Tokyo (JP); Naoaki Utagawa, Tokyo (JP); Tetsuya Shibata, Tokyo (JP)

(73) Assignee: TDK Corporation, Tokyo (JP)

( * ) Notice: Subject to any disclaimer, the term of this patent is extended or adjusted under 35 U.S.C. 154(b) by 453 days.

(21) Appl. No.: 12/715,887

(22) Filed: Mar. 2, 2010

(65) Prior Publication Data

US 2010/0225542 A1 Sep. 9, 2010

(30) Foreign Application Priority Data

Mar. 3, 2009 (JP) ..... 2009-049971

(51) Int. Cl.
*H01Q 1/38* (2006.01)

(52) U.S. Cl.
USPC ..... 343/700 MS; 343/702; 343/829; 343/846

(58) Field of Classification Search ..... None
See application file for complete search history.

(56) References Cited

U.S. PATENT DOCUMENTS 6,614,398 B2 * 9/2003 Kushihi et al. ..... 343/700 MS
7,319,431 B2 1/2008 Jeon et al.
2007/0171131 A1 * 7/2007 Sorvala et al. ..... 343/700 MS
2009/0040120 A1 2/2009 Tsubaki et al.
2010/0225542 A1 * 9/2010 Suzuki et al. ..... 343/700 MS
2011/0001672 A1 * 1/2011 Harihara ..... 343/702
2011/0133993 A1 * 6/2011 Utagawa et al. ..... 343/700 MS

FOREIGN PATENT DOCUMENTS

JP 11-340726 12/1999
JP 2003-069331 3/2003
JP 2004-064353 2/2004
JP 2008-294491 A 12/2008

OTHER PUBLICATIONS

European Search Report issued in European Patent Application No. 10002131.0-2220, mailed Jun. 29, 2010.

* cited by examiner

*Primary Examiner* — Trinh Dinh
(74) *Attorney, Agent, or Firm* — McDermott Will & Emery LLP

(57) ABSTRACT

An antenna device includes an antenna element and a printed circuit board on which the antenna element is mounted. The antenna element includes a base, a radiation conductor formed on an upper surface of the substrate and one end of the radiation conductor being an open end, a plurality of terminal electrodes formed on a bottom surface of the substrate, and a loop conductor of a substantially U-shape. The loop conductor is arranged to face one of the terminal electrodes via a gap having a predetermined width. An antenna mounting region is provided on a upper surface of the printed circuit board to be adjacent to an edge of a long side of the printed circuit board. A feed line is led in the antenna mounting region along the edge. One and the other end of the loop conductor are connected to the feed line and a ground pattern, respectively.

15 Claims, 21 Drawing Sheets

ANTENNA DEVICE AND ANTENNA ELEMENT USED THEREFOR

RELATED APPLICATIONS

This application claims priority under 35 U.S.C. 119 from JAPAN Patent Application No. 2009-049971 filed on Mar. 3, 2009, the contents of which are incorporated herein by references.

TECHNICAL FIELD

The present invention relates to an antenna device and an antenna element used therefor, and more particularly relates to a surface-mounted antenna device that is built in a small-size portable terminal such as a mobile-phone.

BACKGROUND OF THE INVENTION

In recent years, a chip antenna for GPS (Global Positioning System) or Bluetooth is built in a small-size portable terminal such as a mobile-phone. A chip antenna of this type is required to be small in size and to facilitate resonance frequency adjustment and impedance matching. This is because the resonance frequency and the input impedance of the chip antenna are affected by the structure of the printed circuit board, various electronic components mounted around the chip antenna, and the housing. Therefore, it is necessary to adjust the resonance frequency and the input impedance for each model.

Particularly, it is very important to facilitate the input impedance adjustment of an antenna for the following reason. When the input impedance does not match a feeder-side impedance, VSWR characteristics of the antenna deteriorate and the antenna cannot exhibit performance inherent in the antenna. To facilitate input impedance matching, Japanese Patent Application Laid-Open No. 11-340726 discloses an antenna device having the following structure. A U-shaped radiation conductor, a ground conductor, and a feeder-to-ground short-circuit conductor are formed on an upper surface of a substrate, a bottom surface thereof, and a side surface thereof, respectively. An inductance value of the feeder-to-ground short-circuit conductor is changed by adjusting a branching point of the feeder-to-ground short-circuit conductor, thereby adjusting an input impedance of the antenna.

Furthermore, Japanese Patent Application Laid-Open No. 2003-69331 discloses the following surface-mount antenna. A double-housing (inverted-U) feeder electrode is formed on a side surface to an upper surface of a substrate, a length of the feeder electrode is adjusted, thereby changing an inductance value and matching an input impedance to a feeder-side impedance. In a case of this antenna, even when a capacitance between a radiation electrode and a feeder electrode increases because of use of a high permittivity material for the substrate, it is possible to increase the inductance of the feeder electrode, cancel an increase of the capacitance, and facilitate impedance matching.

However, with the conventional antenna structure described in the Japanese Patent Application Laid-Open No. 11-340726, the feeder-to-ground short-circuit conductor is formed in a wide range from the side surface to the upper surface of the substrate, which requires a sufficient area to form a conductor pattern. That is, there is a problem that the substrate needs to be high to some extent, and that it is difficult to make the substrate short.

Furthermore, with the conventional antenna structure described in the Japanese Patent Application Laid-Open No. 11-340726, the feeder-to-ground short-circuit conductor and the radiation conductor are capacitively coupled on the same plane or a plane orthogonal to the same plane. Intensity of capacitive coupling depends on a gap width. Therefore, when the gap width is small, a resonance frequency is low. When the gap width is large, the resonance frequency is low. Accordingly, when a low resonance frequency is to be obtained, a gap width should be set narrow. However, when the gap width is narrow, the antenna is made sensitive to a change in the resonance frequency and there is a problem that it becomes very difficult to adjust the resonance frequency. In addition, because of concentration of electric field on the narrow gap, there is also a problem that the bandwidth is made narrow.

A conventional antenna structure disclosed in Japanese Patent Application Laid-Open No. 2003-69331 has a similar problem to that disclosed in the Japanese Patent Application Laid-Open No. 11-340726. That is, a feeder electrode is formed on a side surface of a substrate and impedance matching is made by adjusting a length of the feeder electrode. Accordingly, it is necessary to secure an area necessary to form the feeder electrode on the side surface of the substrate, making it difficult to provide a short substrate.

SUMMARY OF THE INVENTION

Therefore, an object of the present invention is to provide an antenna device and an antenna element capable of facilitating adjustment of resonance frequency and impedance matching, making a base have a small height, and making a band wide.

To solve the above problems, an antenna device according to the present invention includes: an antenna element; and a printed circuit board on which the antenna element is mounted, wherein the antenna element includes: a base that is made of dielectric material and has substantially rectangular parallelepiped shape; a radiation conductor that is formed on an upper surface of the base and one end thereof being an open end; and a plurality of terminal electrodes formed on a bottom surface of the base, the printed circuit board includes: an insulating substrate; an antenna mounting region that is a substantially rectangular insulating region provided on a surface of the insulating substrate in contact with an edge of a long side of the insulating substrate; a ground pattern that is formed on a surface of the insulating substrate so as to define three sides of the antenna mounting region excluding a side having the edge; a feed line that is led into the antenna mounting region along the edge; and a ground clearance region that is free of conductor patterns, and is formed on a bottom surface and an inner layer of the insulating substrate located immediately below the antenna mounting region, a loop conductor of a substantially U-shape is provided in a region where the antenna element overlaps with the printed circuit board, one end of the loop conductor is connected to the feed line, the other end of the loop conductor is connected to the ground pattern, and at least a part of the loop conductor is arranged to face a first terminal electrode via a gap having a predetermined width, the first terminal electrode being one of the plurality of terminal electrodes and connected to the other end of the radiation conductor.

According to the present invention, the loop conductor constituting inductance is provided in a region where the bottom surface of the base is adjacent to the printed circuit board, and sandwiched between the base and the printed circuit board, that is, between dielectric members. Therefore, it is possible to improve wavelength reduction effect of the dielectric, thereby reducing a length of the loop conductor.

Furthermore, according to the present invention, because the wavelength reduction effect can reduce the length of the loop conductor, only the bottom surface of the base can be used as a surface on which the loop conductor is formed. That is, the base can be made short because there is no need to use the side surface of the base differently from conventional techniques.

According to the present invention, first capacitive coupling is made between the terminal electrode and the first strip conductor pattern, and second capacitive coupling is made by a parallel plate structure between the radiation conductor and the loop conductor located on upper and lower surfaces of the base, respectively. Therefore, it is possible to increase a capacitance of the entire antenna element. Accordingly, a capacitance obtained by the first capacitive coupling can be reduced by as much as the capacitance obtained by the second capacitive coupling when a desired capacitance is to be obtained. That is, contribution of the capacitance obtained by the first capacitive coupling can be set low, so that a gap width can be made large. As a result, it is possible to prevent an electrode structure excessively sensitive to frequency from being formed. Therefore, it is possible to realize an antenna device having stable characteristics. Besides, wideband can be ensured because of no concentration of an electric field on the gap.

In the present invention, it is preferable that the antenna element includes a ground conductor formed on a first side surface of the base in a direction orthogonal to a longitudinal direction of the base, the ground conductor having an upper end connected to the other end of the radiation conductor, the first terminal electrode is formed on one longitudinal end of the bottom surface of the base, the one longitudinal end being adjacent to the first side surface, the plurality of terminal electrodes further include second and third terminal electrodes formed on both ends of other longitudinal end of the base in a width direction of the base, respectively, on the bottom surface of the base, the printed circuit board includes first to third lands provided in the antenna mounting region to correspond to the first to third terminal electrodes, respectively, the loop conductor includes a first strip conductor pattern arranged to face the first terminal electrode via the gap having a predetermined width, and that the one end of the loop conductor is connected to the feed line via the second land.

According to the present invention, the first capacitive coupling is made between the first terminal electrode and the first strip conductor pattern, and the second capacitive coupling is made by the parallel plate structure between the radiation conductor and the loop conductor located on upper and lower surfaces of the base, respectively. Therefore, it is possible to increase a capacitance of the entire antenna element. Accordingly, when a desired capacitance is to be obtained, the capacitance obtained by the first capacitive coupling can be reduced by as much as the capacitance obtained by the second capacitive coupling. It is possible to prevent an electrode structure excessively sensitive to frequency from being formed. Therefore, it is possible to realize an antenna device having stable characteristics.

In the present invention, it is preferable that the loop conductor is provided entirely in a region where the antenna element overlaps with the printed circuit board, and the other end of the loop conductor is connected to the ground pattern via the third land. With this structure, the wavelength reduction effect can be further improved because an entire upper portion of the loop conductor is covered with the base made of the dielectric material.

In the present invention, it is preferable that the loop conductor further includes second and third strip conductor patterns parallel to long sides of the insulating substrate. One end of the second strip conductor pattern is connected to the second land pattern, and the other end of the second strip conductor pattern is connected to one end of the first strip conductor pattern. One end of the third strip conductor pattern is connected to the third land pattern, and the other end of the third strip conductor pattern is connected to the other end of the first strip conductor pattern.

In the present invention, it is preferable that the antenna device further includes a frequency adjustment pattern formed in the antenna mounting region, wherein the frequency adjustment pattern is a fourth strip conductor pattern extending from a substantially longitudinal central portion of the first strip conductor pattern. With this structure, a resonance frequency of the antenna device can be easily adjusted without using external elements.

In the present invention, it is preferable that the antenna device further includes an impedance adjustment pattern formed in the antenna mounting region, and that the impedance adjustment pattern is a fifth strip conductor pattern provided in parallel to the first strip conductor pattern so as to make a loop size of the loop conductor small. With this structure, an input impedance of the antenna device can be easily adjusted without using external elements.

In the present invention, it is preferable that the first strip conductor pattern includes a meander pattern. With this structure, the loop size can be made larger even more and the input impedance of the antenna device can be easily adjusted without using external elements.

In the present invention, it is preferable that the loop conductor includes: a through-hole conductor that penetrates an insulating substrate; and a sixth strip conductor pattern formed on a bottom surface of the insulating substrate, one end of the through-hole conductor is connected to the other end of the loop conductor, and that the other end of the through-hole conductor is connected to a ground pattern formed on the bottom surface of the insulating substrate via the sixth strip conductor pattern.

In the present invention, it is preferable that the antenna mounting region is provided within a range of ±25% from a center of the printed circuit board in the longitudinal direction. With this structure, in an antenna device having a so-called ground clearance type antenna mounting structure, the antenna mounting region is adjacent to the edge of the long side of the printed circuit board and further provided in a range of ±25% from the midpoint of the long side of the printed circuit board. Therefore, it is possible to keep a current flowing to a ground surface on the printed circuit board in balance. Accordingly, an electromagnetic wave can be radiated from the entire printed circuit board including the antenna element, and even a very small antenna can obtain high radiation efficiency.

In the present invention, it is preferable that direction of long sides of the ground clearance region is perpendicular to the longitudinal direction of the printed circuit board, and the aspect ratio of the ground clearance region is 1.5 or higher. By setting the aspect ratio of the ground clearance region is equal to or higher than 1.5, it is possible to increase a current flowing to a central portion of the printed circuit board, thereby further improving the radiation efficiency of the antenna device.

In the present invention, it is preferable that the antenna element is mounted on the printed circuit board so as to cause short-circuit between one ground part and the other ground part defining two opposing sides of the antenna mounting region. By mounting the antenna element in this way, it is possible to sufficiently fulfill an LC adjustment function when the entire printed circuit board is caused to operate as an antenna.

To solve the above problems, an antenna element according to the present invention includes: a base that is made of dielectric material and has substantially rectangular parallelepiped shape; a radiation conductor that is formed on an upper surface of the base and one end thereof being an open end; a ground conductor that is formed on a first side surface of the antenna element in a direction orthogonal to a longitudinal direction of the base, the ground conductor having an upper end connected to the other end of the radiation conductor; a first terminal electrode that is formed on one longitudinal end of the bottom surface of the base, the one longitudinal end being adjacent to the first side surface; second and third terminal electrodes formed on both ends of other longitudinal end of the base in a width direction of the base, respectively, on the bottom surface of the base; and a loop conductor of a substantially U-shape that is formed on the bottom surface of the base, wherein the loop conductor includes a first strip conductor pattern arranged to face the first terminal electrode via a gap having a predetermined width.

According to the present invention, the loop conductor constituting inductance is provided in a region where the bottom surface of the base is adjacent to the printed circuit board when the antenna element is mounted on the printed circuit board, and the loop conductor is sandwiched between the base and the printed circuit board, that is, between the dielectric members. Therefore, it is possible to improve the wavelength reduction effect of the dielectric, thereby reducing the length of the loop conductor. Accordingly, the base can be downsized, that is, the antenna device can be downsized and short.

According to the present invention, because the loop conductor is provided to be adjacent to the bottom surface of the base, there is no need to form the loop conductor on the side surface of the base. Therefore, it is possible to provide the antenna device having the base made short. Furthermore, according to the present invention, an inductance value can be changed by changing the shape of the loop conductor and the input impedance can be thereby adjusted without greatly changing the resonance frequency. This can facilitate impedance matching.

BRIEF DESCRIPTION OF THE DRAWINGS

The above and other objects, features and advantages of this invention will become more apparent by reference to the following detailed description of the invention taken in conjunction with the accompanying drawings, wherein:

FIG. 3A is a layout of the upper surface 20A of the printed circuit board 20, and FIG. 3B is a layout of the bottom surface 20B of the printed circuit board 20;

FIG. 10A shows a layout of the upper surface 20*a* of the printed circuit board 20 and FIG. 10B shows a layout of the bottom surface 20*b* of the printed circuit board 20;

FIG. 20A is a result of the measurement of the return loss, and FIG. 20B is the result of the measurement of the radiation efficiency; FIG. 21A is a result of the measurement of the return loss, and FIG. 21B is the result of the measurement of the radiation efficiency.

DETAILED DESCRIPTION OF THE EMBODIMENTS

Preferred embodiments of the present invention will be described in detail hereinafter with reference to the accompanying drawings.

Figure 1:
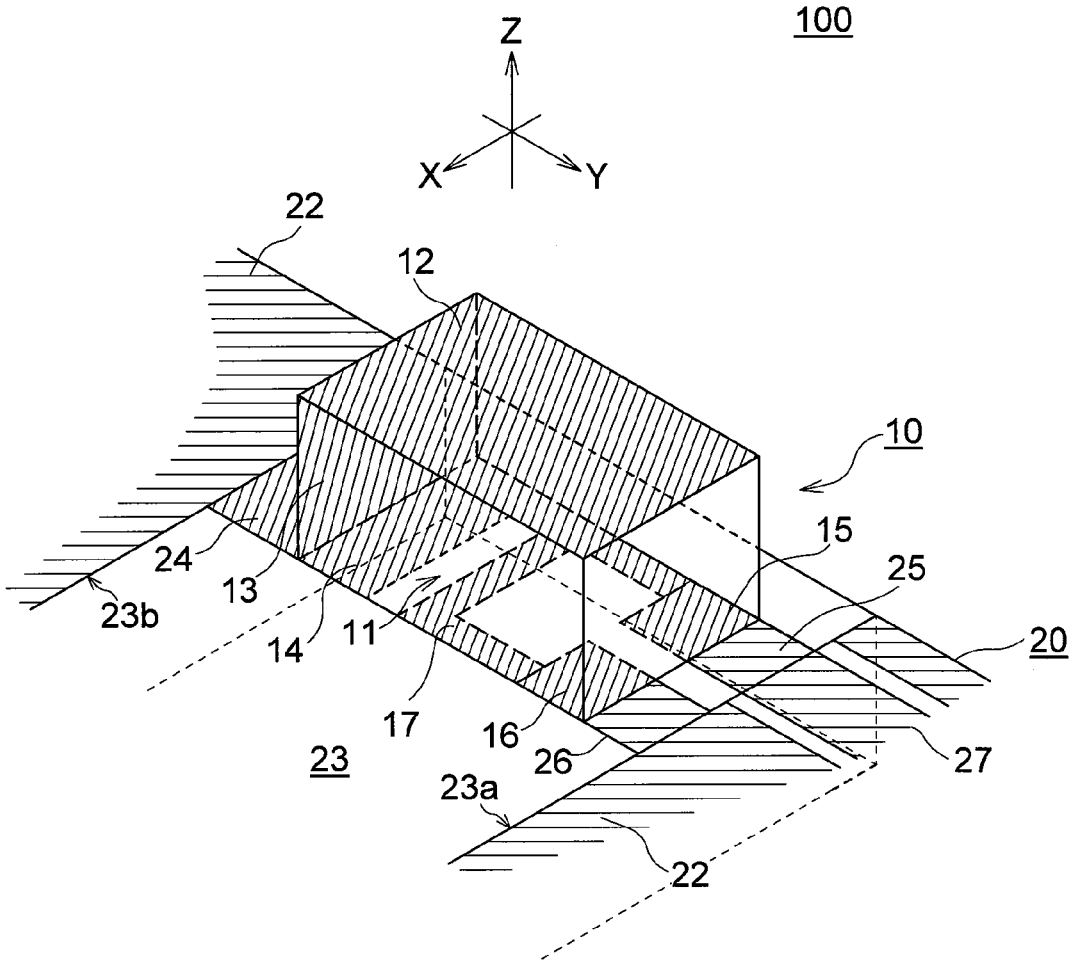
FIG. 1 is a schematic perspective view of a configuration of an antenna device 100 according to a first embodiment of the present invention.
Figure 2:
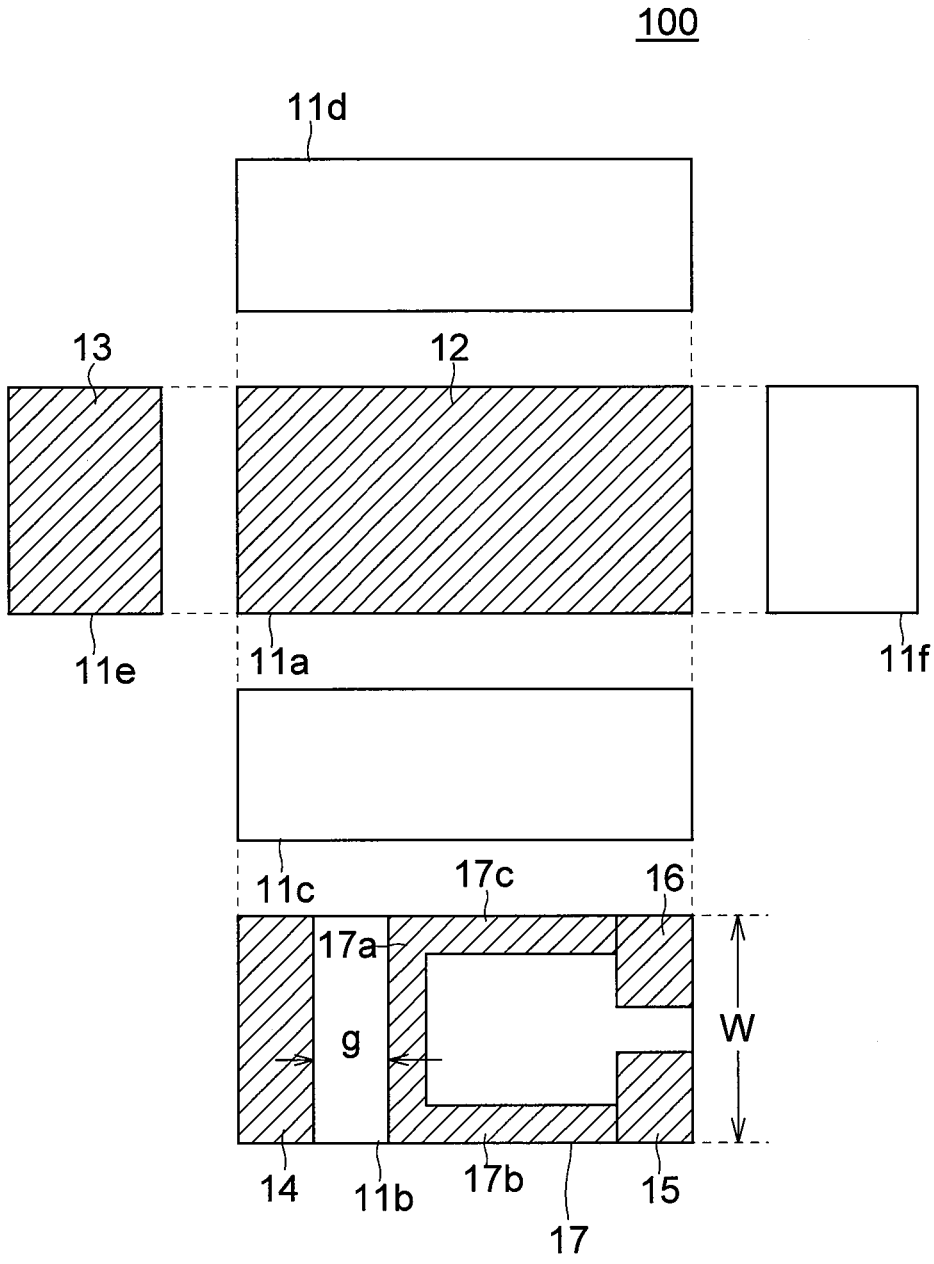
FIG. 2 is a development view of an antenna element 10.

FIG. 1 is a schematic perspective view showing a configuration of an antenna device 100 according to a first embodiment of the present invention. FIG. 2 is a development view of an antenna element 10.

As shown in FIG. 1, an antenna device 100 according to the first embodiment includes the antenna element 10 and a printed circuit board 20 on which the antenna element 10 is mounted. The antenna element 10 is mounted in an antenna mounting region 23 provided on one principal surface (an upper surface) of the printed circuit board 20. The antenna device 100 according to this embodiment does not perform an antenna operation only with the antenna element 10, but rather performs an antenna operation in cooperation with a ground pattern on the printed circuit board 20. In this sense, the antenna element 10 may be an LC adjustment element for adjusting an inductance component (L) and a capacitance component (C) of the entire antenna device including the printed circuit board 20.

The antenna element 10 includes a base 11 made of dielectric material and a plurality of conductor patterns formed on the base 11. The base 11 has rectangular parallelepiped shape, with its longitudinal direction being the Y-direction. Among surfaces of the base 11, an upper surface 11*a*, a bottom surface 11*b*, and two side surfaces 11*c* and 11*d* are parallel to the Y direction. Side surfaces 11*e* and 11*f* are orthogonal to the Y direction. The bottom surface 11*b* is the mounting face with respect to the printed circuit board 20. A vertical direction of the antenna element 10 is defined by the principal surface of the printed circuit board 20 set as a reference surface.

The material of the base 11 is not specifically limited. Examples of the materials include Ba—Nd—Ti (a relative permittivity of 80 to 120), Nd—Al—Ca—Ti (a relative permittivity of 43 to 46), Li—Al—Sr—Ti (a relative permittivity of 38 to 41), Ba—Ti (a relative permittivity of 34 to 36), Ba—Mg—W (a relative permittivity of 20 to 22), Mg—Ca—Ti (a relative permittivity of 19 to 21), sapphire (a relative permittivity of 9 to 10), alumina ceramics (a relative permittivity of 9 to 10), cordierite ceramics (a relative permittivity of 4 to 6), and the likes. The base 11 is produced by burning powder of those materials with the use of a mold.

The dielectric material can be appropriately selected in accordance with the target frequency. When a relative permittivity $\in_r$ is higher, greater wavelength reduction effect can be obtained and a radiation conductor can be made shorter. In this case, however, radiation efficiency deteriorates. Therefore, a higher relative permittivity $\in_r$ is not always appropriate but there is an appropriate relative permittivity for the target frequency. When the target frequency is 2.4 GHz, for example, it is preferable to use a material with relative permittivity $\in_r$ of approximately 5 to 30 for the base 11. By using such a material, the base 11 can be made smaller in size while securing sufficient radiation efficiency. As a material having a relative permittivity $\in_r$ of about 5 to 30, it is preferable to use, for example, Mg—Ca—Ti dielectric ceramic. As the Mg—Ca—Ti dielectric ceramic, it is particularly preferable to use the Mg—Ca—Ti dielectric ceramic containing $TiO_2$, MgO, CaO, MnO, and $SiO_2$.

As shown in FIG. 2, the conductor patterns of the antenna element 10 include a radiation conductor 12 formed on the upper surface 11*a* of the base 11, a ground conductor 13 formed on the side surface 11*e* of the base 11, terminal electrodes 14 to 16 formed on the bottom surface 11*b* of the base 11, and a loop conductor 17 formed, together with the terminal electrodes 14 to 16, on the bottom surface 11*b* of the base 11. These conductor patterns can be formed by applying a conductive past by such a technique such as screen printing or transfer printing, and baking the conductive paste under a predetermined temperature condition. The conductive paste may be silver, silver-palladium, silver-platinum, copper or the like. Alternatively, the conductor patterns may be formed by plating, sputtering or the like.

The radiation conductor 12 is formed on the entire upper surface 11*a* of the base 11, the ground conductor 13 is formed on the entire side surface 11*e* of the base 11, and the radiation conductor 12 and the ground conductor 13 constitute a continuous band pattern. One end of the radiation conductor 12 in the Y direction is open and the other end thereof is connected to an upper end of the ground conductor 13. A lower end of the ground conductor 13 is connected to the first terminal electrode 14.

The terminal electrodes 14 to 16 are formed on the bottom surface 11*b* of the base 11. More specifically, the terminal electrode 14 is formed at one end of the bottom surface 11*b* in the Y direction and the terminal electrodes 15 and 16 are formed on the other end thereof. The terminal electrode 14 is formed along the entire width direction (an X direction) of the bottom surface 11*b*, and the terminal electrodes 15 and 16 are formed at a predetermined distance from each other in the width direction (X-direction) of the bottom surface 11*b*. That is, when a width of the bottom surface 11*b* is defined as W, a width of the terminal electrode 14 is W, and a width of each of the terminal electrodes 15 and 16 is less than W/2.

The loop conductor 17 as well as the terminal electrodes 14 to 16 is formed on the bottom surface 11*b* of the base 11. The loop conductor 17 is a substantially U-shaped conductor pattern formed on the bottom surface 11*b* of the base 11. One end of the loop conductor 17 is connected to the terminal electrode 15 and the other end thereof is connected to the terminal electrode 16. The loop conductor 17 includes a first strip conductor pattern 17*a* extending in the X direction and second and third strip conductor patterns 17*b* and 17*c* extending in the Y direction. One end of the second strip conductor pattern 17*b* is connected to the terminal electrode 15, one end of the third strip conductor pattern 17*c* is connected to the terminal electrode 16, and both ends of the first strip conductor pattern 17*a* are connected to other ends of the second and third strip conductor patterns 17*b* and 17*c*, respectively, thereby forming a substantially U-shaped loop.

In this embodiment, the second strip conductor pattern 17*b* adjoins one long side of the bottom surface 11*b* of the base, and the third strip conductor pattern 17*c* adjoins the other long side of the bottom surface 11*b*. With such a configuration, the loop conductor 17 can be made to have the largest loop size. When there is no need to make the loop conductor 17 largest in size, the loop conductor 17 can be arranged inside of the long sides of the bottom surface 11*b*.

One side of the first strip conductor pattern 17*a* constituting the loop conductor 17 is parallel to one side of the terminal electrode 14, and the side of the first strip conductor pattern 17*a* and the side of the terminal electrode 14 are arranged to face each other across a gap g having a constant width. With this arrangement, a capacitance is formed between the loop conductor 17 and the terminal electrode 14, so that the loop conductor 17 can be electromagnetically coupled to the terminal electrode 14. When the capacitance is to be set high, it suffices to narrow the gap g. To narrow the gap g, it suffices to elongate the second and third strip conductor patterns 17*b* and 17*c* to make the first strip conductor pattern 17*a* closer to the terminal electrode 14. Conversely, it suffices to elongate the terminal electrode 14 to make the terminal electrode 14 closer to the first strip conductor pattern 17*a*.

In the first embodiment, the loop conductor 17 is formed on the bottom surface 11*b* of the base 11. Therefore, it is possible to obtain not only a capacitance component resulting from the gap g but also a capacitance component resulting from a parallel plate structure including the radiation conductor 12 formed on the upper surface 11*a* of the base 11 and the loop conductor 17. Accordingly, the antenna element 10 according to the first embodiment can obtain a higher capacitance than that of the antenna element having a conventional structure in which gaps g are formed on side and upper surfaces of the base 11. In other words, when a predetermined capacitance is to be obtained, contribution of the capacitance component resulting from the gap g can be set small and a gap width can be made large while considering the capacitance component resulting from the parallel plate structure. The large gap width can prevent an electrode structure excessively sensitive to frequency from being formed. Therefore, it is possible to realize high fabrication yield and stable antenna characteristics.

Those conductor patterns formed on the respective surfaces of the base 11 are preferably formed to be bilaterally symmetric about a plane in parallel to the side surfaces 11*c* and 11*d* of the base 11. By forming these conductor patterns in this way, even when the antenna element 10 is rotated by 180 degrees about an axis perpendicular to upper and bottom surfaces of the base 11 (the Z-axis), the conductor pattern arrangement of the antenna element 10 viewed from the edge side of the printed circuit board 20 is substantially the same in shape as those that are not rotated. Accordingly, the antenna characteristics do not greatly vary with the orientation of the antenna element 10, and the antenna design can be made easier.

Figure 3A:
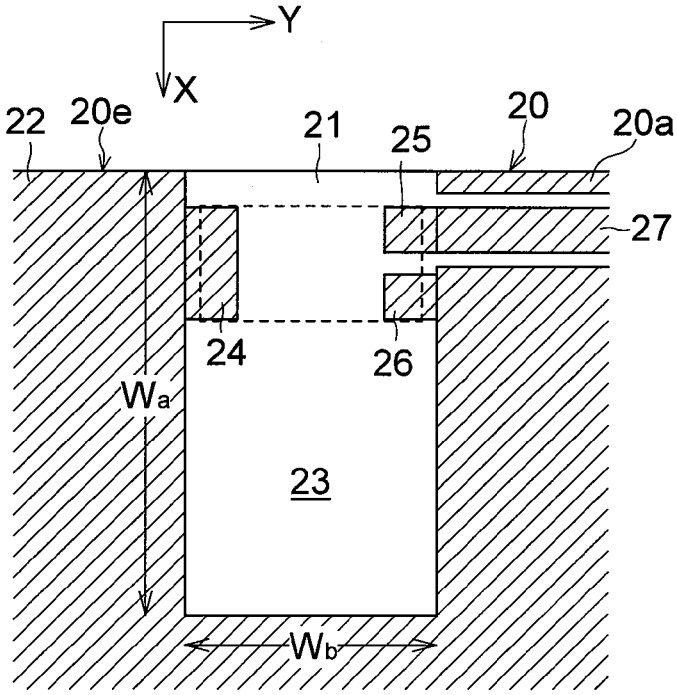
FIGS. 3A and 3B are schematic plan views of the pattern layouts of the printed circuit board 20 on which the antenna element 10 is mounted, specifically
Figure 3B:
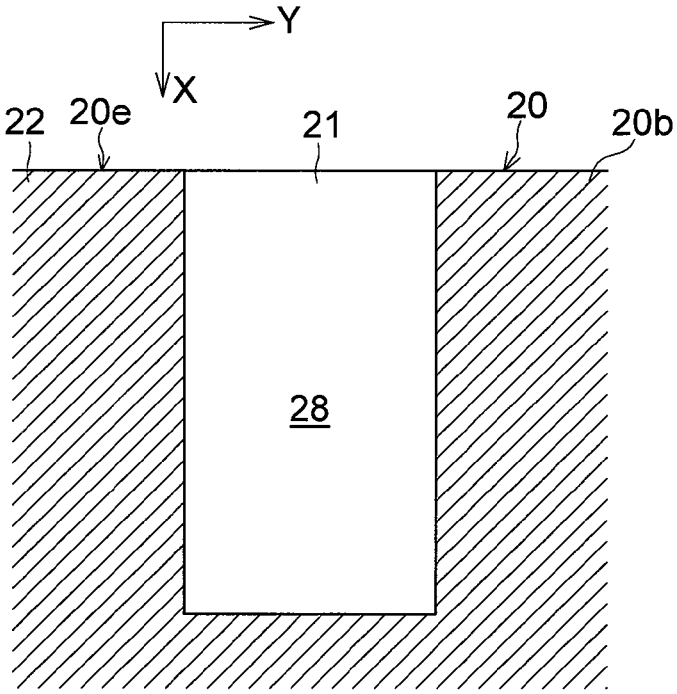

FIGS. 3A and 3B are schematic plan views of the pattern layout of the printed circuit board 20 on which the antenna element 10 is mounted. FIG. 3A shows the layout of the upper surface 20*a* of the printed circuit board 20, and FIG. 3B shows the layout of the bottom surface 20*b* of the printed circuit board 20. Particularly, FIG. 3B transparently shows the layout of the bottom surface 20*b* viewed from the upper surface 20*a* side.

As shown in FIGS. 3A and 3B, the printed circuit board 20 has conductor patterns formed on the upper and bottom surfaces of the insulating substrate 21.

More specifically, the substantially rectangular antenna mounting region 23 having one side in contact with an edge 20*e* of a long side of the printed circuit board 20 and three other sides defined by a ground pattern 22 is provided on the upper surface 20*a* of the printed circuit board 20.

The antenna mounting region 23 is a rectangular insulating region excluding the ground pattern 22, and three lands 24 to 26 are provided in the antenna mounting region 23. If the antenna mounting region 23 is placed on the edge 20*e* of the printed circuit board 20, a half space viewed from the antenna element 10 is a free space where the printed circuit board (the ground pattern) 20 is not present. This can improve radiation efficiency of the antenna device 100.

The lands 24 to 26 are connected to the terminal electrodes 14 to 16 of the antenna element 10, and have the same widths as those of the corresponding terminal electrodes 14 to 16. The lands 24 and 26 are connected to the adjacent ground pattern 22, and the land 25 is connected to a feed line 27. With this arrangement of the lands, the antenna element 10 causes short-circuit between the portion of the ground patterns on both sides of the antenna mounting region 23 in the Y direction, and functions as an LC adjustment element for the entire ground pattern 22.

A ground clearance region 28 that is an insulating region having substantially the same shape as the antenna mounting region 23 on the upper surface 20*a* in a plan view is provided on the bottom surface 20*b* of the printed circuit board 20. Since any component is not mounted on the ground clearance region 28 on the bottom surface 20*b*, any conductor pattern such as a land is not formed in the ground clearance region 28. If the printed circuit board 20 is a multilayer board, it is necessary to form such a ground clearance region 28 not only on the bottom surface 20*b* but also in inner layers. In other words, an insulating region that is free of a ground pattern needs to extend immediately below the antenna mounting region 23. Such a mounting structure is called a "ground clearance type", while a structure having a ground pattern covering the area immediately below the antenna mounting region 23 is called an "on-ground type".

The antenna element 10 is mounted in the antenna mounting region 23 that is wider than a chip antenna formed by partially removing the ground pattern 22 existing on the printed circuit board 20. In case of the ground clearance type, nothing can be mounted below the antenna element 10, and a large substrate area is ensured. However, since there is no ground surface at all, the height of the antenna (base) can be reduced. In the case of the on-ground type, on the other hand, there is a ground surface on the mounting surface and the region existing below the mounting surface. Although the height of the antenna element is larger than that in the case of a ground clearance type, the bottom surface of the multilayer board can be used as a component mounting region, with the upper surface of the multilayer board being the antenna mounting surface, the inner layer being a ground pattern layer. Therefore, the antenna can be substantially made in small.

The antenna mounting region 23 is a rectangular region that extends in a direction (the X direction) perpendicular to the longitudinal direction of the printed circuit board 20. Where Wa represents the length of each long side of the antenna mounting region 23, and Wb represents the length of each short side of the antenna mounting region 23, the following relationship is preferably satisfied: $Wa/Wb \geqq 1.5$. More specifically, where the short side length Wb is 3 mm, the long side length Wa is preferably 4.5 mm or greater. By setting the aspect ratio of the antenna mounting region 23 at 1.5 or higher, the current flowing in the center portion of the printed circuit board 20 can be increased. Accordingly, the radiation efficiency of the antenna can be made higher, and more particularly, radiation efficiency of 50% or higher can be secured.

Figure 4:
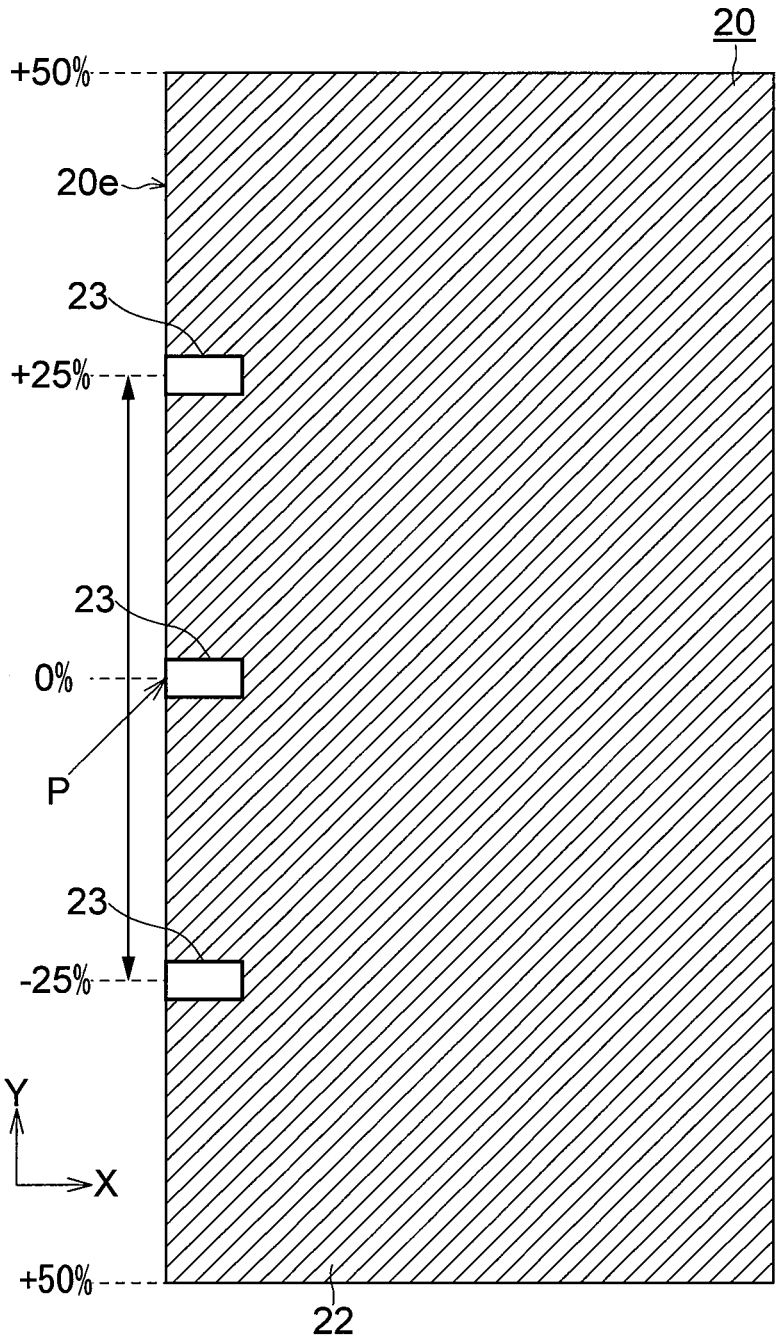
FIG. 4 is a schematic plan view showing a preferred formation position of the antenna mounting region 23.

FIG. 4 is a schematic plan view showing a preferred formation position of the antenna mounting region 23.

As shown in FIG. 4, the antenna mounting region 23 is in contact with the edge 20*e* of the long side of the printed circuit board 20. In this case, the antenna mounting region 23 is provided within a range of ±25% from a midpoint (a reference point) P on the long side of the printed circuit board 20.

A reference point of the antenna mounting region 23 is a midpoint of the short side of the printed circuit board 20. In this way, when the antenna mounting region 23 is provided within the range of ±25% from the midpoint P on the long side of the printed circuit board 20, a balance can be maintained between the currents flowing in the regions on both sides of the printed circuit board 20 in its longitudinal direction, when seen from the antenna mounting region 23. Accordingly, the radiation efficiency of the antenna can be made higher, and more particularly, radiation efficiency of 50% or higher can be secured.

As shown in FIG. 1, when the antenna element 10 is mounted on the printed circuit board 20, one end of the loop conductor 17 is connected to the feed line 27 via the land 25, and the other end of the loop conductor 17 is connected to the ground pattern 22 via the land 26. In addition, the lower end of the ground conductor 13 is connected to the ground pattern 22 via the land 24. As a result, the antenna element 10 is mounted on the printed circuit board 20 so as to cause short-circuit between one and the other portion of the ground pattern defining the two opposing sides 23*a* and 23*b* of the antenna mounting region 23.

A feeding current I1 is supplied from an RF circuit (not shown) via the feed line 27. The feeding current I1 is fed to the loop conductor 17 connected to the feed line 27 from the feed line 27, and the feeding current I1 flows into the ground pattern 27 via the loop conductor 17. Because the loop conductor 17 extending from the feed line 27 is connected to the ground pattern 22 in the same direction as that of the feed line 27, inductance can be efficiently generated. In addition, because the first strip conductor pattern 17*a* of the loop conductor 17 is capacitively coupled to the first terminal electrode 14 via the gap g, a inductive current I2 according to the feeding current I1 flows in the first terminal electrode 14. The feeding current I1 and the inductive current I2 flow in the direction orthogonal to the longitudinal direction and the inductive current I2 is fed to the radiation conductor 12 via the ground conductor 13. As a result, a radiation current I flows in the radiation conductor 12 in the Y direction. Further, the inductive current I2 flows into the ground pattern 22 on the printed circuit board 20 via the ground conductor 13, and then radiated as an electromagnetic wave from the entire ground pattern 22.

A reason for forming an electromagnetic field using the entire ground pattern 22 on the printed circuit board 20 is explained next.

In a case of a Bluetooth antenna, for example, the resonance frequency f is 2.43 GHz (resonance wavelength $\lambda$=12.35 cm), and the required bandwidth BW is 3.5%. Where the Bluetooth antenna having an antenna length L of 2 mm is constituted with the use of a base of 2.0×1.2×1.0 mm, a wavelength ratio (a) of the antenna length L satisfies $a=2\pi L/\lambda=0.1023$. Where the radiation efficiency ($\eta$) is 0.5 ($\eta$=0.5, the radiation efficiency being 50%), the Q factor (Q) satisfies $Q=\eta(1+3a^2)/a^3(1+a^2)=476.8365$. When VSWR(S) is 2 (S=2), the bandwidth (BW) is obtained as $BW=(s-1)\times 100/(\sqrt{s}\times Q)$ [%] and BW=0.1%. That is, when the antenna length L of the Bluetooth antenna is 2 (L=2), the antenna cannot satisfy the bandwidth 3.5%.

As can be understood, a very small chip antenna having an antenna length L smaller than $\lambda/2\pi$ is theoretically incapable of achieving antenna characteristics better than those obtained by the above equations with a single antenna element. Therefore, it is quite important for the very small chip antenna to allow the entire ground pattern 22 on the printed circuit board 20 to operate as an antenna with high efficiency using the current flowing in the ground pattern 22 on the printed circuit board 20.

Figure 5:
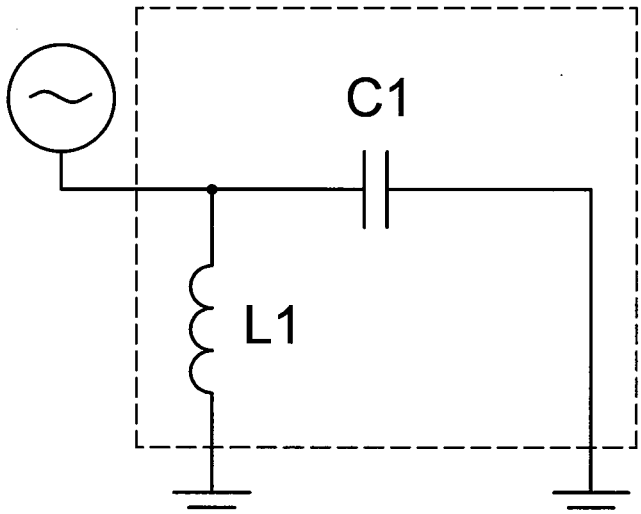
FIG. 5 is an equivalent circuit diagram of the antenna element 10 mounted on the printed circuit board 20.

FIG. 5 is an equivalent circuit diagram of the antenna element 10 mounted on the printed circuit board 20.

As shown in FIG. 5, the antenna element 10 is an LC parallel circuit inserted between a feed line and a ground. The gap g between the terminal electrode 14 and the loop conductor 17 and a gap between the loop conductor 17 and the radiation conductor 12 in a height direction mainly form a capacitance C1. The loop conductor 17 forms an inductance L1. In this equivalent circuit, the resonance frequency of the antenna device 100 can be changed by adjusting the capacitance C1. When the gap width becomes smaller, the capacitance C1 becomes higher, and the resonance frequency becomes lower. When the gap width becomes larger, the capacitance C1 becomes lower and the resonance frequency becomes lower. Furthermore, an input impedance of the antenna device 100 can be changed by adjusting the inductance L1 without changing the resonance frequency. When a loop size of the inductance adjustment pattern 13 becomes larger, the inductance L1 becomes larger. When the loop size thereof becomes smaller, the inductance L1 becomes lower. Therefore, the impedance can be adjusted by adjusting the magnitude of the loop.

Figure 6:
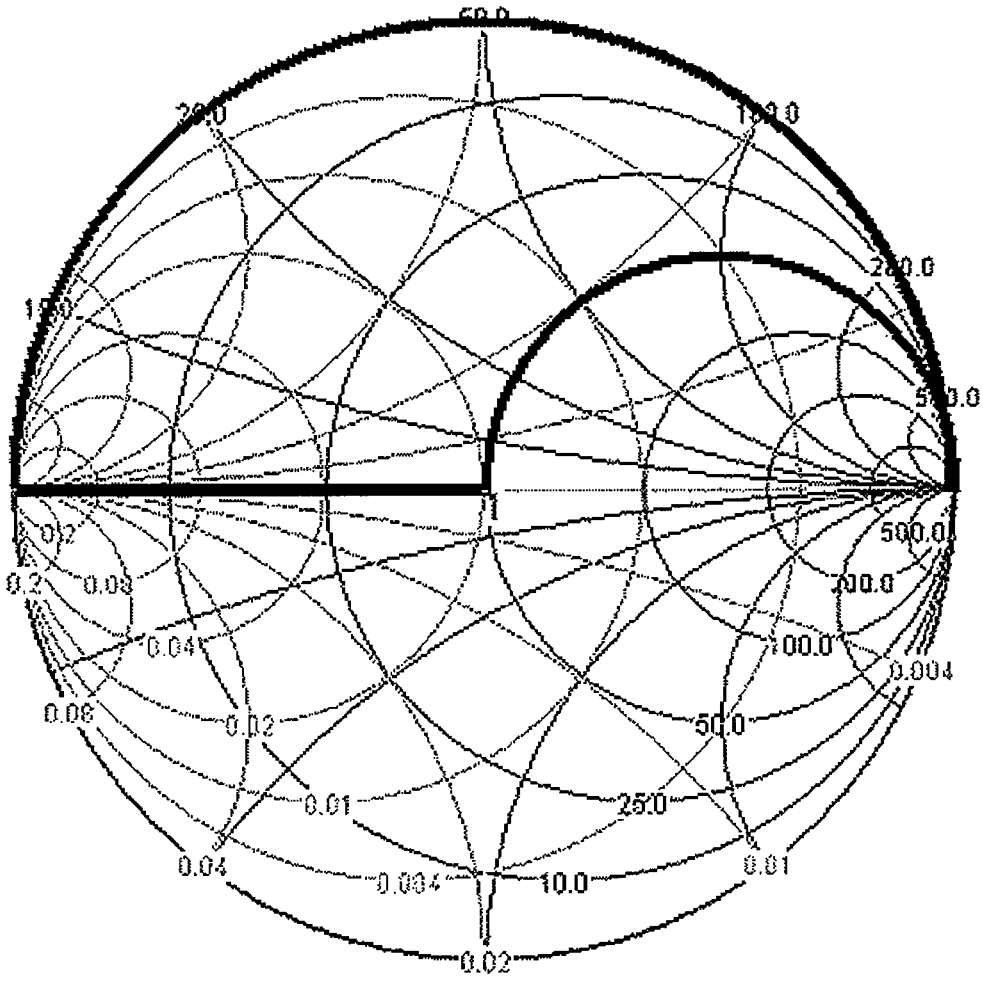
FIG. 6 is a Smith chart showing a preferable range of the input impedance of the printed circuit board 20.

FIG. 6 is a Smith chart showing a preferable range of the input impedance of the printed circuit board 20.

As shown in FIG. 6, the input impedance of the printed circuit board 20 a conductor surface of which is patterned and on which the antenna element 10 is not mounted is preferably within a range indicated by a thick line in the Smith chart. That is, an input impedance R of the printed circuit board 20 preferably satisfies $R \leqq 50\Omega$ and in a range of inductive reactance. When the input impedance R of the printed circuit board 20 is within this range, the input impedance R can be adjusted by adjusting the inductance L1 connected in parallel to the capacitance C1.

Figure 7A:
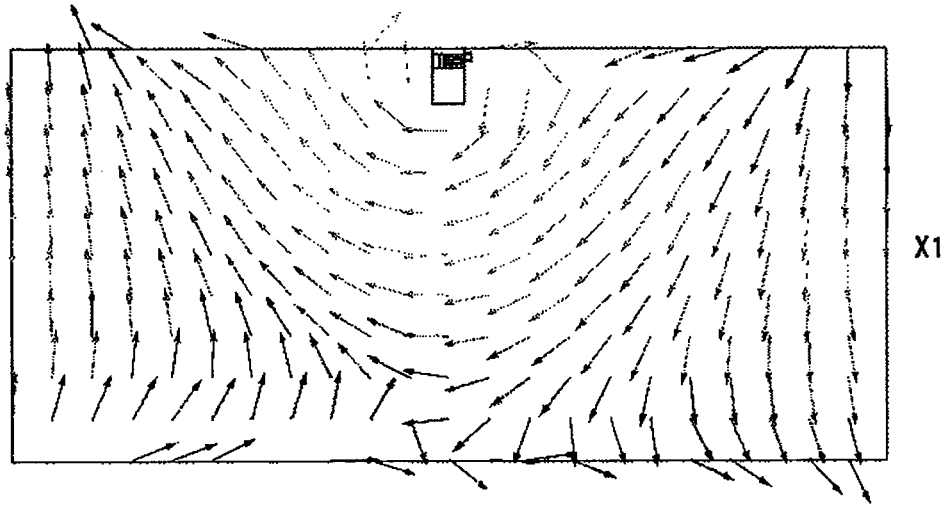
FIGS. 7A to 7C are schematic diagrams showing the results of simulations performed to examine the current distributions on the printed circuit board 20.
Figure 7B:
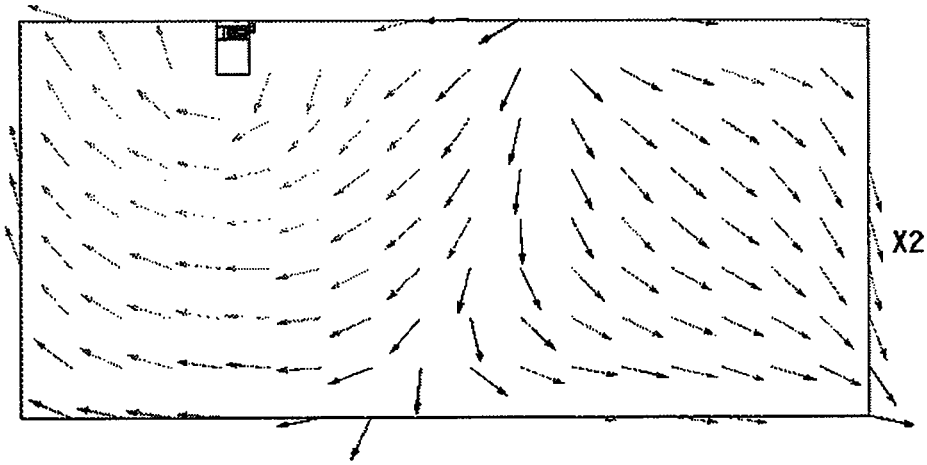
Figure 7C:
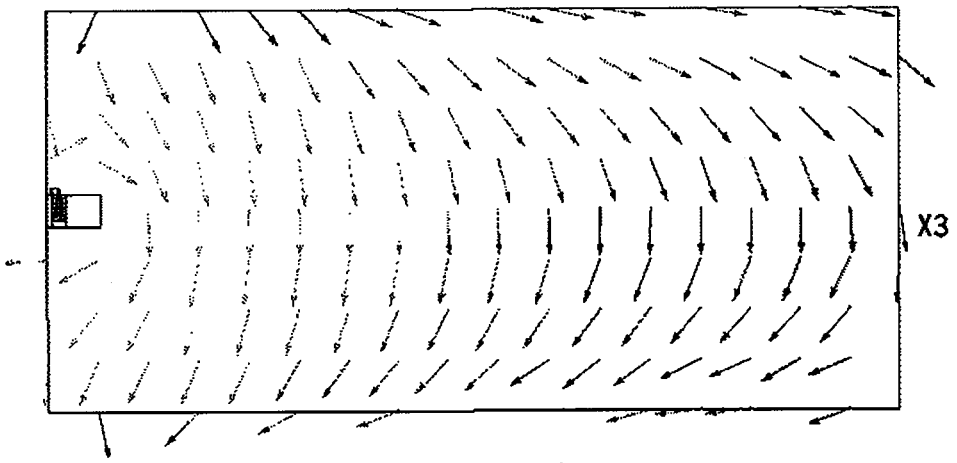

FIGS. 7A to 7C are pattern diagrams showing the results of simulations performed to examine the current distributions on the printed circuit board 20. FIG. 7A shows the result obtained in a-case where the antenna mounting region 23 is located at the reference point P (0%) (sample X1), FIG. 7B shows the result obtained in a case where the antenna mounting region 23 is located at the position of −25% (sample X2), and FIG. 7C shows the result obtained in a case where the antenna mounting region 23 is located at the midpoint of one short side of the printed circuit board 20 (a sample X3). The printed circuit board 20 to be evaluated through the simulations has a ground pattern formed on the entire substrate surface, except for the antenna mounting region 23. The arrows in the drawings indicate the directions of current flows, and the tones of the arrows indicate the intensities of currents. Darker arrows indicate larger currents, and lighter arrows indicate smaller currents.

As shown in FIG. 7A, when the antenna mounting region 23 is located at the reference point P, the current distribution on the printed circuit board 20 shows that a balance is maintained between the currents floating in the right-side region and the left-side region with respect to the longitudinal direction of the printed circuit board 20 seen from the antenna mounting region 23. Accordingly, the electromagnetic wave can be more efficiently radiated from the entire printed circuit board including the antenna element 10.

On the other hand, as shown in FIG. 7B, when the antenna mounting region 23 is located at the position of −25%, the current distribution on the printed circuit board 20 shows that the current distribution in the left half of the printed circuit board 20 including the antenna mounting region 23 greatly differs from the current distribution in the remaining right half. The intensity of the current is higher in the left half, and is lower in the right half. Since a balance is not maintained between the current flowing in the left-side region and the current floating in the right-side region with respect to the longitudinal direction of the printed circuit board 20 seen from the antenna mounting region 23, a decrease in electromagnetic wave radiation efficiency is easily predicted.

Furthermore, as shown in FIG. 7C, when the antenna mounting region 23 is in contact with a short side of the printed circuit board 20 and is located at the midpoint of the short side, the current distribution maintains a balance between the right-side region and the left-side region seen from the antenna mounting region 23. However, the intensity of the current flowing in regions further away from the antenna mounting region 23 is very low. Therefore, electromagnetic waves are hardly efficiently radiated from the entire substrate, and the radiation efficiency is considered lower than the radiation efficiency achieved in the case illustrated in FIG. 7A.

Figure 8:
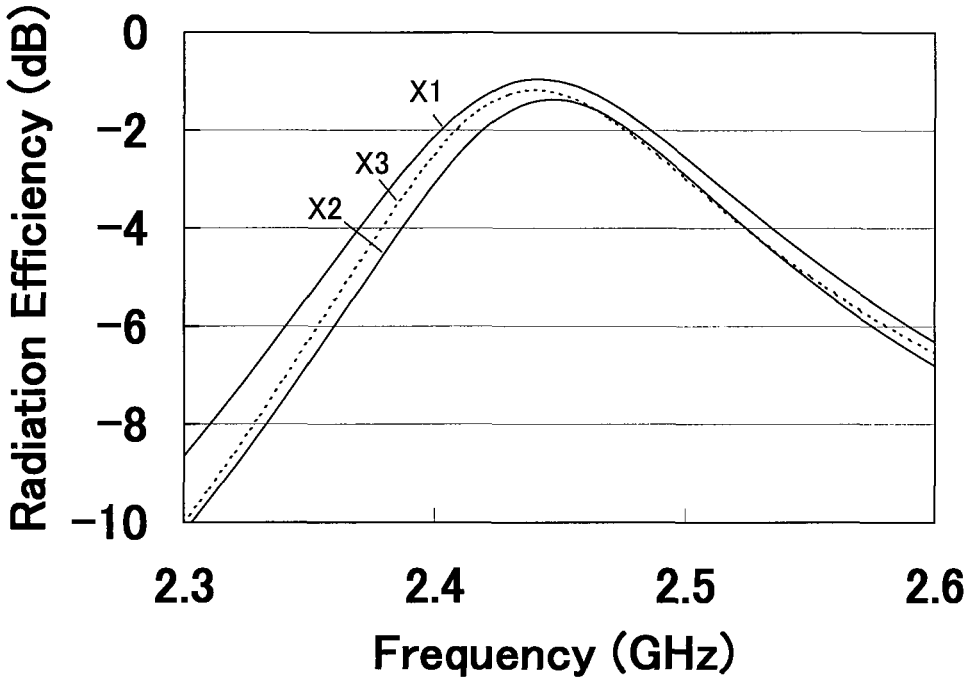
FIG. 8 is a graph showing radiation efficiencies achieved by placing the antenna mounting region 23 at the respective positions illustrated in FIGS. 7A to 7C, respectively.

FIG. 8 is a graph showing radiation efficiencies achieved by placing the antenna mounting region 23 at the respective positions illustrated in FIGS. 7A to 7C, respectively.

As shown in FIG. 8, the radiation efficiency of the antenna is the highest in a case of the sample X1 in which the antenna mounting region 23 is at the position shown in FIG. 7A. For example, the radiation efficiency is about 0.8 with a frequency near 2.43 GHz. The radiation efficiency is the second highest and about 0.73 in a case of the sample X3 in which the antenna mounting region 23 is at the position shown in FIG. 7C. The radiation efficiency is the lowest in a case of the sample X2 in which the antenna mounting region 23 is at the position shown in FIG. 7B.

As described above, the antenna device 100 according to the first embodiment is configured so that the loop conductor 17 is formed on the bottom surface 11*b* of the base 11 and sandwiched between the base 11 and the printed circuit board 20, that is, between the upper and lower dielectric members. Therefore, it is possible to improve the wavelength reduction effect of the dielectric and thereby reduce an entire length of the loop conductor 17. For example, when the loop conductor 17 is to be formed on an exposed surface of the base 11, the loop conductor 17 needs the entire length of about 10 mm. According to the first embodiment, by contrast, the entire length of the loop conductor 17 can be reduced to 8 mm. Therefore, even when the base 11 is downsized, the loop conductor 17 can be formed.

Moreover, when the loop conductor 17 is formed on the side surface of the base 11 as done in conventional antenna devices, it is necessary to ensure that the base 11 has a certain degree of height so as to secure the length of the loop conductor 17. According to the first embodiment, by contrast, the loop conductor 17 is formed only on the bottom surface 11*b* of the base 11 and not formed on the side surface thereof. Therefore, it is possible to make the base 11 short.

Furthermore, the antenna device 100 according to the first embodiment has the ground clearance type antenna mounting structure. Therefore, even when the base 11 is made short, the radiation characteristics do not deteriorate differently from the on-ground type. Therefore, it is possible to make the antenna element 10 short.

Further, according to the first embodiment, first capacitive coupling is realized by the gap g between the first terminal electrode 14 and the first strip conductor pattern 17*a* and second capacitive coupling is realized by the parallel plate structure between the radiation conductor 12 and the loop conductor 17. Therefore, it is possible to increase the capacitance of the entire antenna element 10. Accordingly, contribution of the capacitance component resulting from the gap g can be set small and a desired capacitance can be secured even when the gap width is made large. The large gap width can prevent an electrode structure excessively sensitive to frequency from being formed. Therefore, it is possible to realize the antenna device 100 having stable antenna characteristics.

Moreover, according to the first embodiment, the antenna element 10 is provided in the antenna mounting region 23 that is the ground clearance region and the ground pattern 22 is not present right under the antenna element 10. Therefore, the entire printed circuit board 20 including the antenna element 10 can be made to operate as an antenna. Particularly when the loop size and the gap width of the loop conductor 17 on the antenna element 10 are changed, it is possible to easily and independently change adjustment of the resonance frequency and input impedance necessary to allow the entire printed circuit board 20 to operate as an antenna.

Furthermore, in the antenna device 100 according to the first embodiment, the antenna mounting region 23 is adjacent to the edge 20*e* of the long side of the printed circuit board 20 and provided in a range of ±25% from the midpoint (the reference point) P in the longitudinal direction of the printed circuit board 20. Therefore, it is possible to efficiently create the electromagnetic field between the conductor pattern formed on the surface of the base 11 made of the dielectric and the surrounding ground pattern 20, thereby improving antenna characteristics.

Additionally, according to the first embodiment, the antenna mounting region 23 is the rectangular region elongated in the width direction orthogonal to the longitudinal direction of the printed circuit board 20 and the aspect ratio of the antenna mounting region 23 is equal to or higher than 1.5. Therefore, it is possible to increase the current flowing to the center of the printed circuit board 20, thereby ensuring the radiation efficiency equal to or higher than 50%.

Another embodiment of the present invention is explained next in detail.

Figure 9:
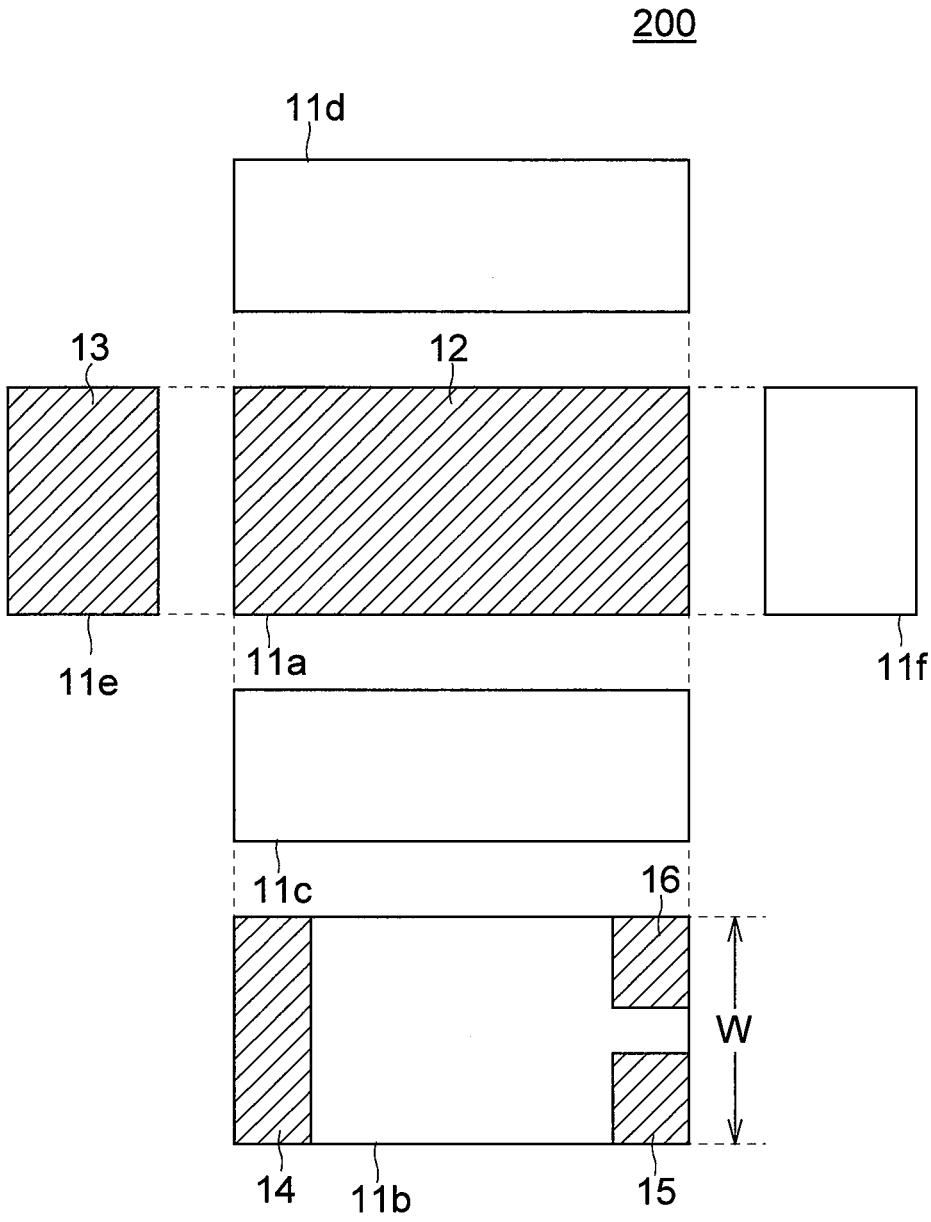
FIG. 9 is a development view showing a configuration of the antenna element 10 of an antenna device 200 according to a second embodiment of the present invention.
Figure 10A:
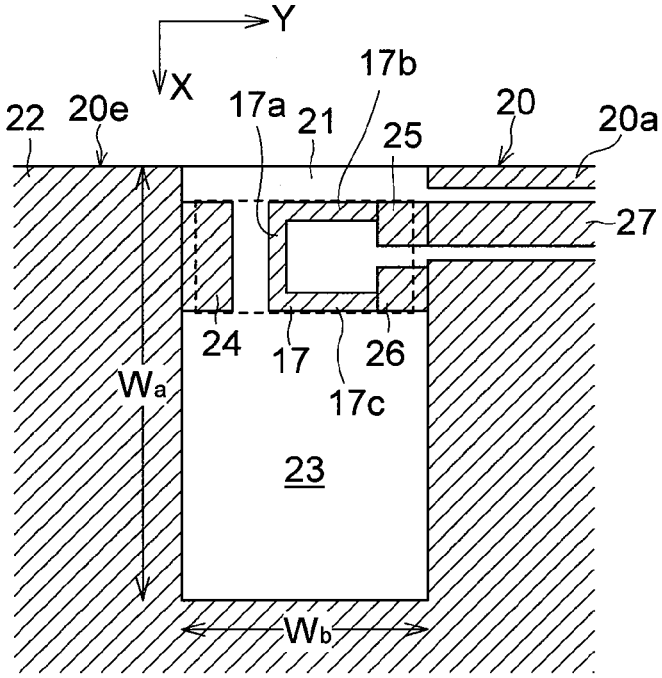
FIGS. 10A and 10B are schematic plan view showing a pattern layout of the printed circuit board 20 on which the antenna element 10 is mounted, specifically
Figure 10B:
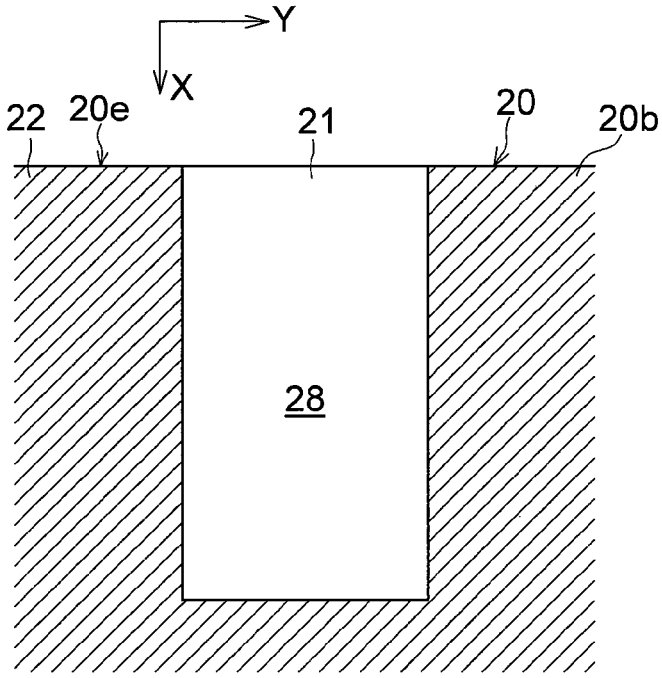

FIG. 9 is a development view showing a configuration of the antenna element 10 of an antenna device 200 according to a second embodiment of the present invention. FIGS. 10A and 10B are schematic plan view showing a pattern layout of the printed circuit board 20 on which the antenna element 10 is mounted. FIG. 10A shows a layout of the upper surface 20*a* of the printed circuit board 20 and FIG. 10B shows a layout of the bottom surface 20*b* of the printed circuit board 20. Particularly, FIG. 10B transparently shows the layout of the bottom surface 20*b* from the upper surface 20*a* side.

As shown in FIGS. 9, 10A and 10B, the antenna device 200 according to the second embodiment is characterized such that the loop conductor 17 is provided not on the antenna element 10 but on the printed circuit board 20. The loop conductor 17 includes the first strip conductor pattern 17*a* extending in the X direction and the second and third strip conductor patterns 17*b* and 17*c* extending in the Y direction. One end of the second strip conductor pattern 17*b* is connected to the land 25, one end of the third strip conductor pattern 17*c* is connected to the land 26, and both ends of the first strip conductor pattern 17*a* are connected to other ends of the second and third strip conductor patterns 17*b* and 17*c*, respectively, thereby forming a substantially U-shaped loop. The first strip conductor pattern 17*a* is arranged to face the first land 26 via a gap g having a predetermined width. Other constituent elements of the antenna device 200 are substantially the same as those of the antenna device 100 according to the first embodiment. Therefore, like constituent elements are denoted by like reference numerals and redundant explanations thereof will be omitted.

In this way, according to the second embodiment, because the loop conductor 17 is formed on the printed circuit board 20 side, it is possible to adjust the shape of the loop conductor 17 on the printed circuit board 20 side and facilitate adjusting inductance. Besides, when the loop conductor 17 is formed on the printed circuit board 20, the following loop conductor can be formed.

Figure 11A:
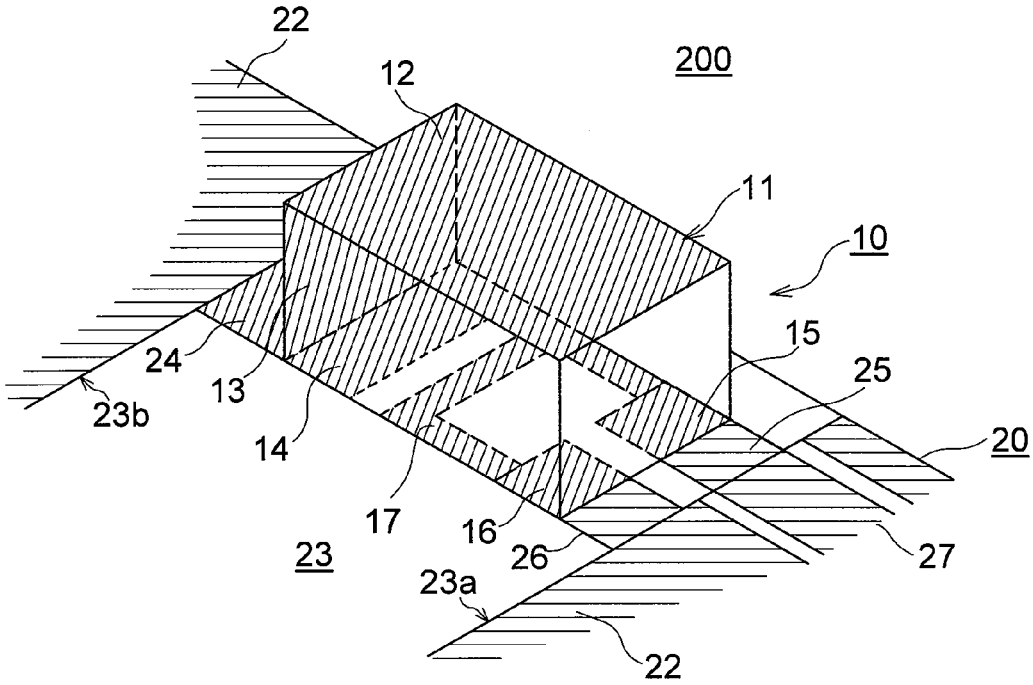
FIGS. 11A and 11B describe the antenna device 200 according to the second embodiment and an antenna device 300 according to a modification of the second embodiment.
Figure 11B:
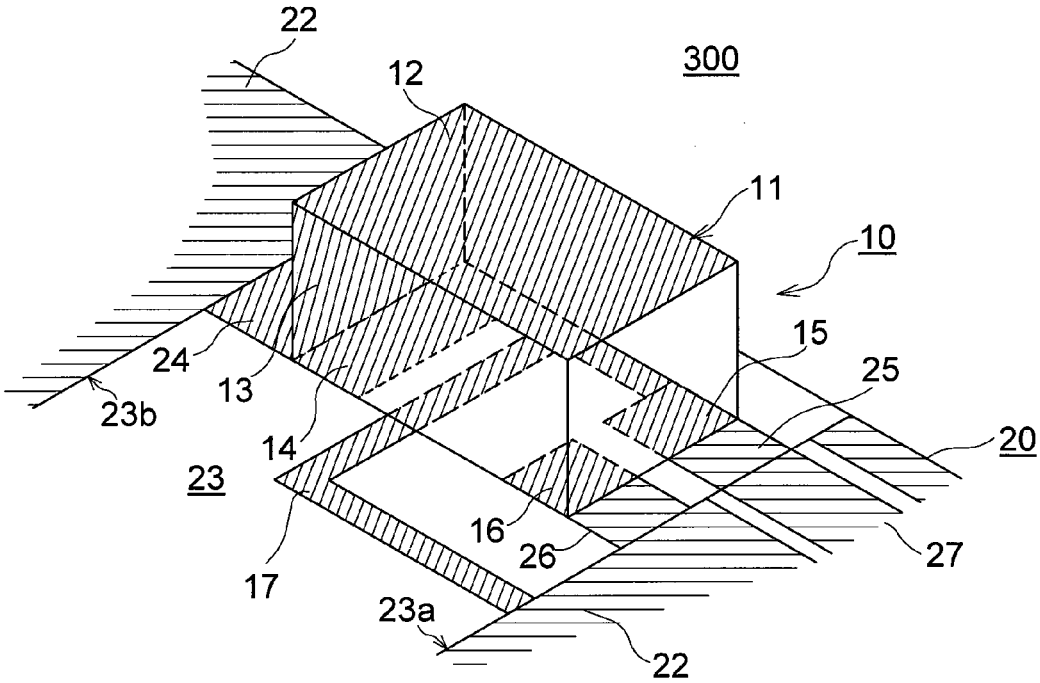
Figure 12:
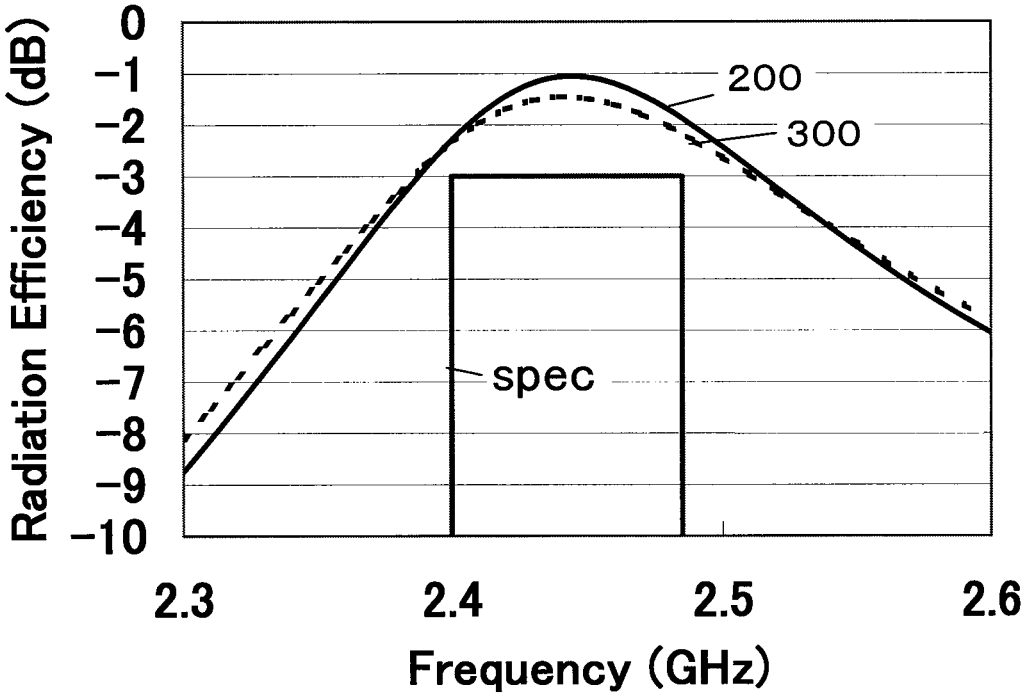
FIG. 12 is a graph showing radiation efficiencies of the antenna devices 200 and 300 shown in FIGS. 11A and 11B, respectively.

FIGS. 11A and 11B describe the antenna device 200 according to the second embodiment and an antenna device 300 according to a modification of the second embodiment. FIG. 11A is a perspective view of the antenna device 200 and FIG. 11B is a schematic perspective view of the antenna device 300. FIG. 12 is a graph showing radiation efficiencies of the antenna devices 200 and 300 shown in FIGS. 11A and 11B, respectively.

The loop conductor 17 of the antenna device 200 shown in FIG. 11A is arranged within a region where the base 11 overlaps with the printed circuit board 20. The loop conductor 17 of the antenna device 300 shown in FIG. 11B protrudes from a region where the base 11 overlaps with the printed circuit board 20 and extends outward of the region. In this case, one end of the loop conductor 17 is connected to the land 24. However, the other end of the loop conductor 17 is not connected to the land 25 but directly connected to the ground pattern 22 on a lead-in side of the feed line 27.

In this way, when the loop conductor 17 is formed on the printed circuit board 20 side to protrude outside of the base 11 and to be exposed, it is possible to form a larger loop. Nevertheless, even when a larger loop is formed, it does not mean that antenna characteristics of the antenna device 300 improve. As shown in FIG. 12, the radiation efficiency of the antenna device 300 including the loop conductor 17 protruding from the base 11 is slightly lower than that of the antenna device 200 including the loop conductor 17 arranged within the base 11. Therefore, it is preferable to form the loop conductor 17 so as not to protrude from the base 11 and particularly preferable to form the loop conductor 17 on the bottom surface 11*b* of the base 11 of the antenna element 11 rather than on the printed circuit board 20.

An antenna characteristic adjustment structure is explained next.

Figure 13:
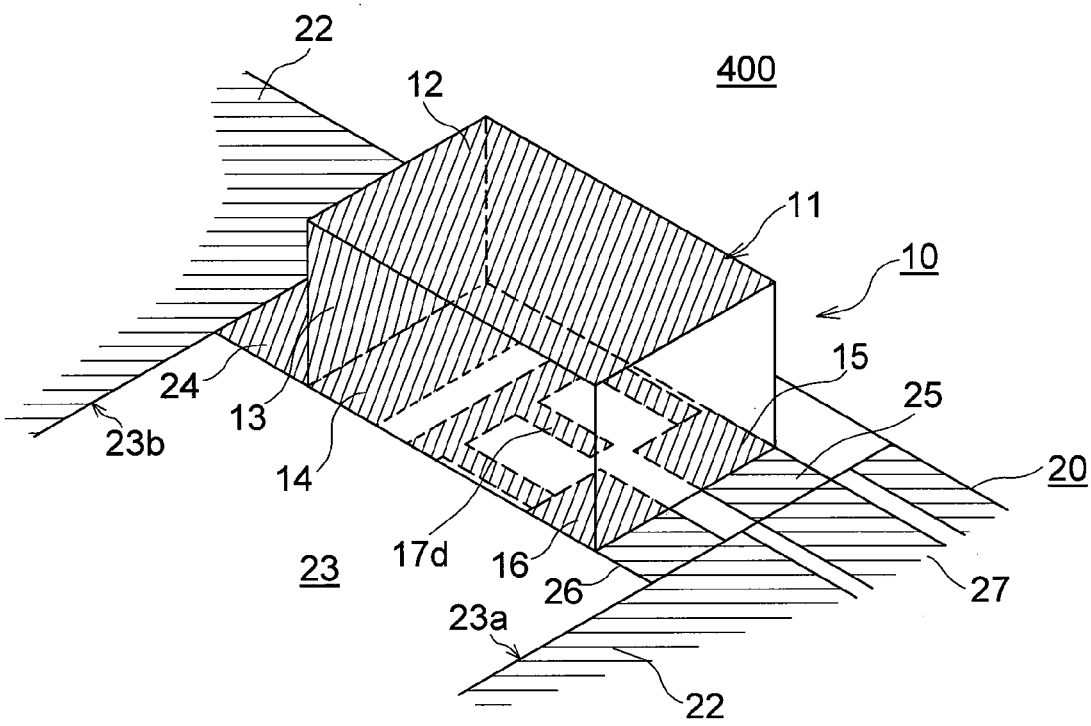
FIG. 13 is a schematic perspective view showing a structure of an antenna device 400 according to a third embodiment of the present invention.

FIG. 13 is a schematic perspective view showing a structure of an antenna device 400 according to a third embodiment of the present invention.

As shown in FIG. 13, the antenna device 400 according to the third embodiment is characterized such that a frequency adjustment pattern 17*d* is provided on either the bottom surface 11*b* of the base 11 or on the printed circuit board 20. The frequency adjustment pattern 17*d* is a strip conductor pattern (the fourth strip conductor pattern) provided in parallel to the second and third strip conductor patterns 17*b* and 17*c* of the loop conductor 17 and extending in the same direction as that of the second and third strip conductor patterns 17*b* and 17*c* thereof. One end of the frequency adjustment pattern 17*d* is connected to a longitudinal central portion of the first strip conductor pattern 17*a* of the loop conductor 17 whereas the other end of the frequency adjustment pattern 17*d* is an open end. When the frequency adjustment pattern 17*d* is longer, a resonance frequency of the antenna device 400 can be set lower. Conversely, when the frequency adjustment pattern 17*d* is shorter, the resonance frequency of the antenna device 400 can be set higher. Accordingly, the resonance frequency is the highest when there is no frequency adjustment pattern 17*d* at all.

It is preferable that such a frequency adjustment pattern 17*d* is provided on the printed circuit board 20 side for the following reason. When the frequency adjustment pattern 17*d* is provided on the printed circuit board 20 side, the resonance frequency can be easily adjusted only by changing conductor patterns on the printed circuit board 20 without changing conductor patterns on the antenna element 10. This means that antenna elements mass-produced to have fixed conductor patterns can be used in various types of antenna devices. That is, even when the frequency needs to be adjusted according to the position on the printed circuit board 20 at which position the antenna element 10 is mounted, it suffices to change the conductor patterns on the printed circuit board 20 without changing the conductor patterns on the antenna element 10.

Figure 14:
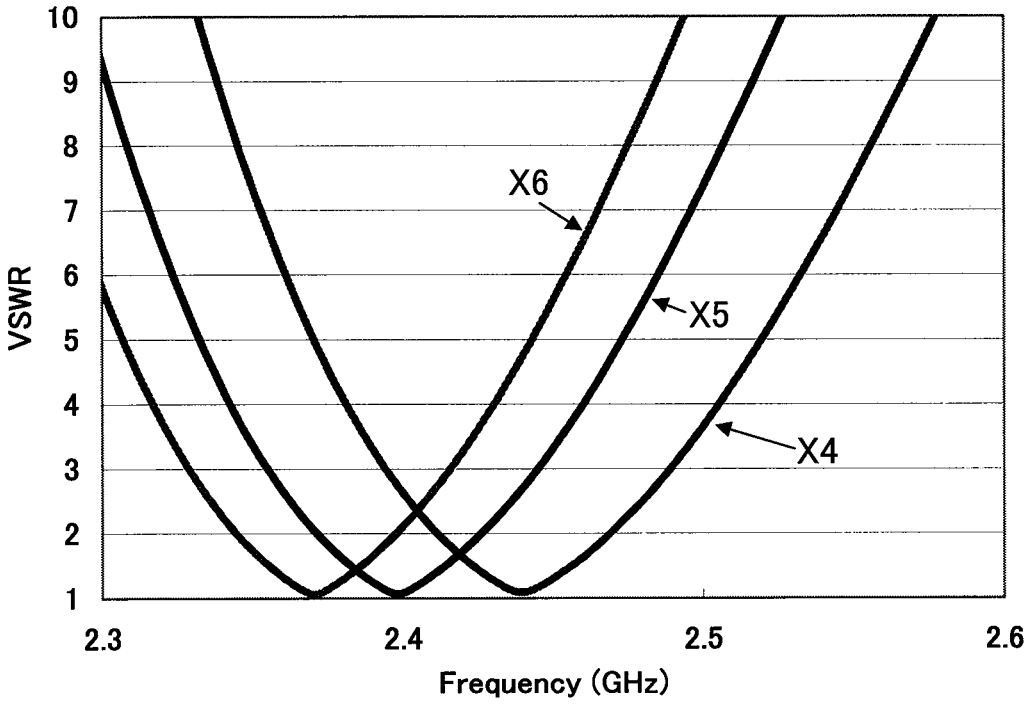
FIG. 14 is a graph showing an example of VSWR characteristics of the antenna device 400.

FIG. 14 is a graph showing an example of VSWR characteristics of the antenna device 400.

As shown in FIG. 14, when a length of the frequency adjustment pattern 17*d* of the antenna device 400 is set to L0 equal to lengths of the second and third strip conductor patterns 17*b* and 17*c*, the resonance frequency of the antenna device 400 is about 2.38 GHz as indicated by a curve X6. When the length of the frequency adjustment pattern 17*d* is set to L0/2 that is half the lengths of the second and third strip conductor patterns 17*b* and 17*c*, the resonance frequency of the antenna device 400 is about 2.40 GHz as indicated by a curve X5. When the frequency adjustment pattern 17*d* is completely excluded, the resonance frequency of the antenna device 400 is about 2.43 GHz as indicated by a curve X4. In this way, by shortening the frequency adjustment pattern 17*d*, the resonance frequency can be shifted to a high frequency side.

As described above, the antenna device 400 according to the third embodiment includes the frequency adjustment pattern 17*d* on either the bottom surface 11*b* of the base 11 or on the printed circuit board 20. Therefore, it is possible to adjust only the resonance frequency of the antenna device 400 without greatly changing the impedance. Further, because it suffices to change only the length of the frequency adjustment pattern 17*d*, the resonance frequency can be adjusted without using external elements and frequency adjustment can be made quite easily.

An impedance adjustment structure of an antenna device is described next.

Figure 15:
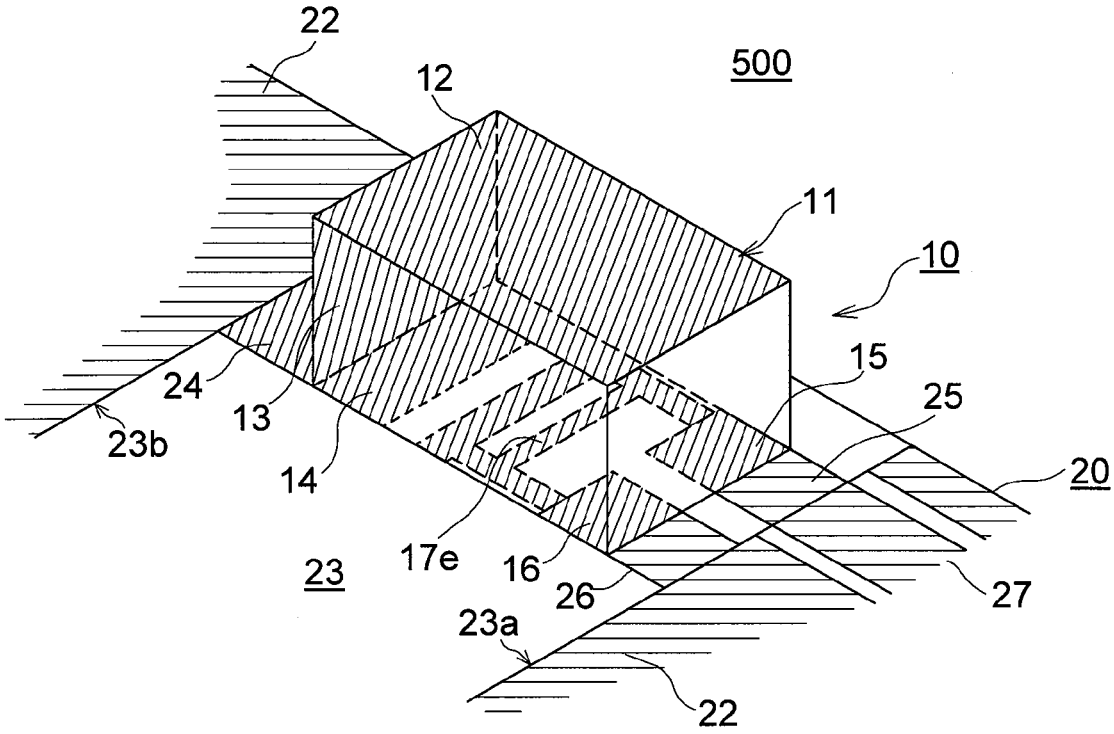
FIG. 15 is a schematic perspective view showing a structure of an antenna device 500 according to a fourth embodiment of the present invention.

FIG. 15 is a schematic perspective view showing a structure of an antenna device 500 according to a fourth embodiment of the present invention.

As shown in FIG. 15, the antenna device 500 according to the fourth embodiment is characterized by providing an impedance adjustment pattern 17*e* on the bottom surface 11*b* of the base 11. The impedance adjustment pattern 17*e* is a strip conductor pattern (the fifth strip conductor pattern) provided in parallel to the first strip conductor pattern 17*a* of the loop conductor 17. Both ends of the impedance adjustment pattern 17*e* are connected to the second and third strip conductor patterns 17*b* and 17*c* of the loop conductor 17, respectively. The impedance adjustment pattern 17*e* functions particularly to cause short-circuit between the second and third strip conductor patterns 17*b* and 17*c* so as to make the loop size of the loop conductor 17 smaller. When the loop size is smaller, inductance is made lower. Conversely, when the loop size is larger, the inductance is made higher.

As described above, the antenna device 500 according to the fourth embodiment includes the impedance adjustment pattern 17*e* either on the bottom surface 11*b* of the base 11 or on the printed circuit board 20. Therefore, it is possible to only adjust an input impedance without greatly changing the resonance frequency of the antenna device 500. In addition, because it suffices to change only a formation position and a width of the impedance adjustment pattern 17*e*, it is possible to adjust the input impedance without using external elements and impedance adjustment can be made quite easily.

Figure 16:
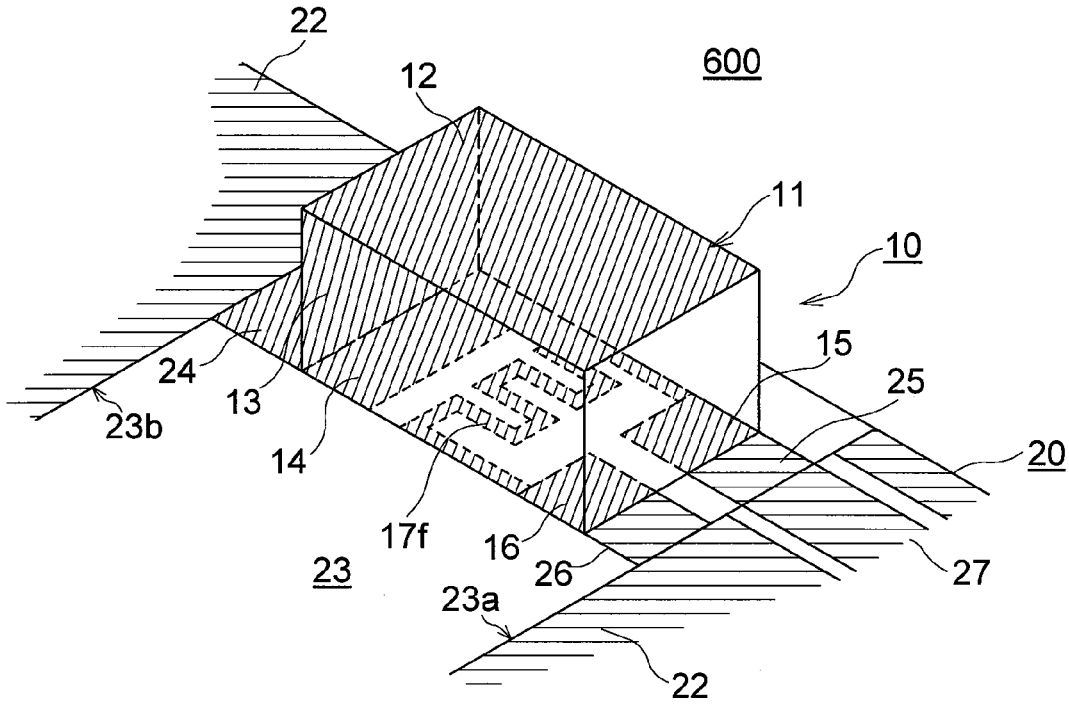
FIG. 16 is a schematic perspective view showing a structure of an antenna device 600 according to a fifth embodiment of the present invention.

FIG. 16 is a schematic perspective view showing a structure of an antenna device 600 according to a fifth embodiment of the present invention.

As shown in FIG. 16, the antenna device 600 according to the fifth embodiment is characterized such that the loop conductor 17 formed on the bottom surface 11*b* of the base 11 includes a meander pattern. That is, a first strip conductor pattern 17*f* of the loop conductor 17 is formed as the meander pattern. When the antenna device 600 is configured as described above, the loop size of the loop conductor 17 is substantially made large. Therefore, it is possible to increase inductance.

Figure 17:
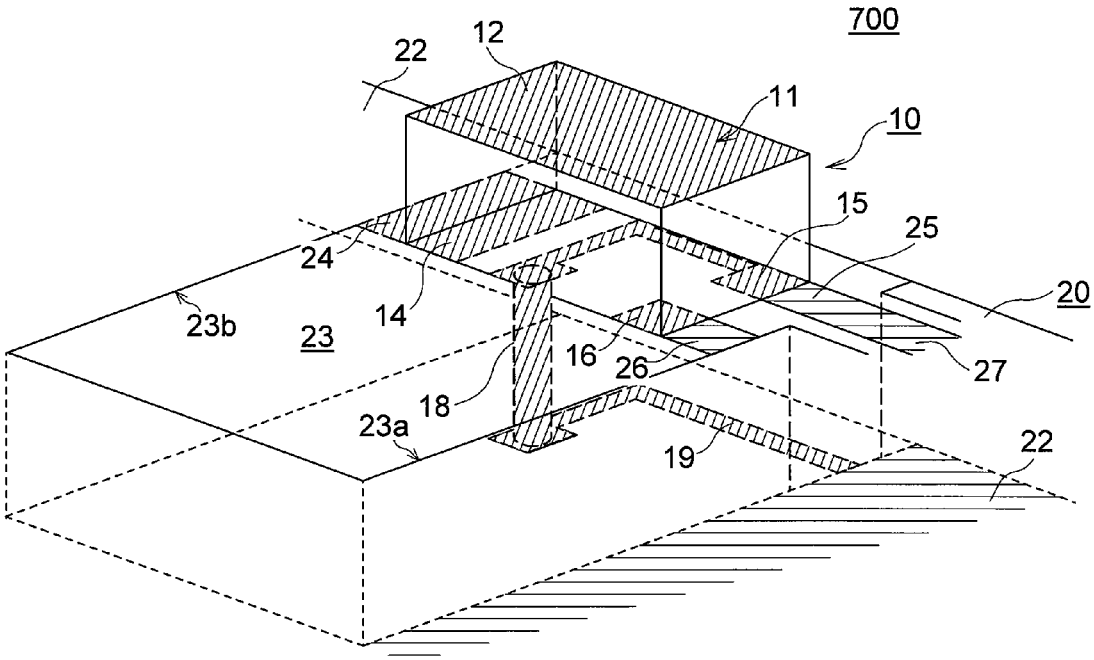
FIG. 17 is a schematic perspective view showing a structure of an antenna device 700 according to a sixth embodiment of the present invention.

FIG. 17 is a schematic perspective view showing a structure of an antenna device 700 according to a sixth embodiment of the present invention.

As shown in FIG. 17, the antenna device 700 according to the sixth embodiment is characterized as follows. One end of the loop conductor 17 is connected not to the land 26 but to the ground pattern 22 formed on the bottom surface 20*b* of the printed circuit board 20 via a through-hole conductor 18 penetrating the printed circuit board 20 and a strip conductor pattern (the sixth strip conductor pattern) 19 formed on the bottom surface 20*b* of the printed circuit board 20. When the antenna device 700 is configured as described above, the loop size of the loop conductor 17 can be made larger even more. Therefore, it is possible to obtain higher inductance than that of the antenna device 600 configured so that the loop conductor 17 includes the meander pattern.

Figure 18:
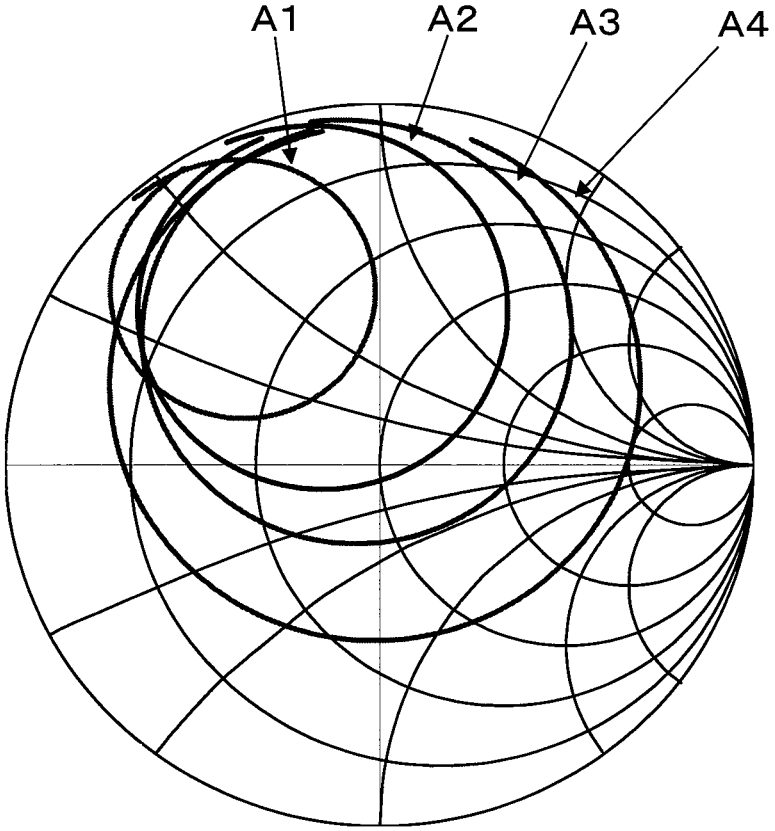
FIG. 18 is a Smith chart showing impedance characteristics of the antenna devices 100 and 500 to 700 according to the first and fourth to sixth embodiments, respectively.

FIG. 18 is a Smith chart showing impedance characteristics of the antenna devices 100 and 500 to 700 according to the first and fourth to sixth embodiments, respectively. In FIG. 18, a line A1 indicates a short loop structure shown in FIG. 15, a line A2 indicates an ordinary loop structure shown in FIG. 1, a line A3 indicates a meander loop structure shown in FIG. 16, and a line A4 indicates impedance characteristics of a through-hole structure shown in FIG. 17.

As shown in FIG. 18, among the antenna devices 100 and 500 to 700, the inductance of the antenna device 500 having the short loop structure is the lowest, and that of the antenna device 100 having the ordinary loop structure, that of the antenna device 600 having the meander loop structure, and that of the antenna device 700 having the through-hole structure are higher in this order. In this way, it is possible to change the inductance only by changing the loop size, thereby easily adjusting the input impedance of the antenna device.

The present invention has thus been shown and described with reference to specific embodiments. However, it should be noted that the present invention is in no way limited to the details of the described arrangements but changes and modifications may be made without departing from the scope of the appended claims.

For example, the base 11 may have a substantially rectangular parallelepiped shape, though the rectangular parallelepiped base 11 is used in the above described embodiment. As long as the above described conductor patterns are formed on the respective surfaces of the base, the corner portions of the base 11 may be cut off, or the base 11 may be partially hollowed out. Also, the printed circuit board 20 may not be a complete rectangular flat board, and may have notches formed at the corners or edges, for example.

EXAMPLES

Example 1

Figure 19:
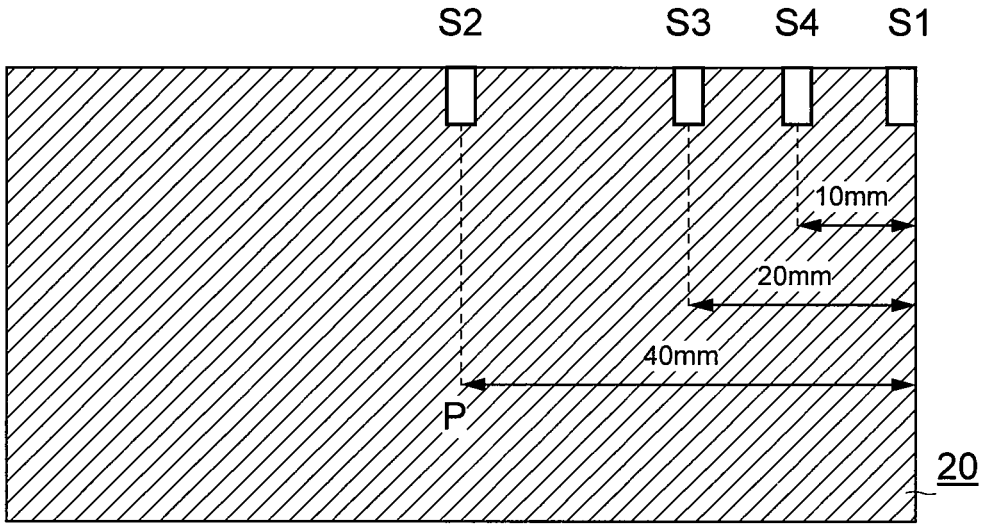
FIG. 19 is a schematic plan view showing the position of the antenna mounting area for explaining the measurement of the antenna characteristics when altering the position of the antenna mounting area.

The antenna characteristics were measured while the position of the antenna mounting region was changed on the printed circuit board. The size of the printed circuit board was 80 mm×37 mm×1 mm, the size of the antenna mounting region was 3.0 mm×4.5 mm, and the chip size of the antenna element was 2.0 mm×1.2 mm×1.0 mm. As shown in FIG. 19, a sample S1 has the antenna mounting region located at the position of 50% from the reference point of the circuit board or at a corner portion of the circuit board, a sample S2 has the antenna mounting region located at the reference point (0%) of the circuit board, a sample S3 has the antenna mounting region located at the position of 25% from the reference point of the circuit board or at the mid point between the reference point and a corner portion, and a sample S4 has the antenna mounting region located at the position of 37.5% from the reference point of the circuit board or at the mid point between the antenna mounting region of the sample S1 and the antenna mounting region of the sample S3. The relative permittivity $\in_r$ of the base of the antenna element was 37, and the conductor patterns on the antenna element were adjusted so that the resonance frequency of each of the samples S1 to S4 became 2.43 GHz, and the input impedance became 50Ω. After that, signals between 2.3 GHz to 2.6 GHz were supplied through a signal line with the use of a network analyzer, and the return loss and radiation efficiency of the antenna device were measured. FIGS. 11A and 11B show the results of the measurement.

Figure 20A:
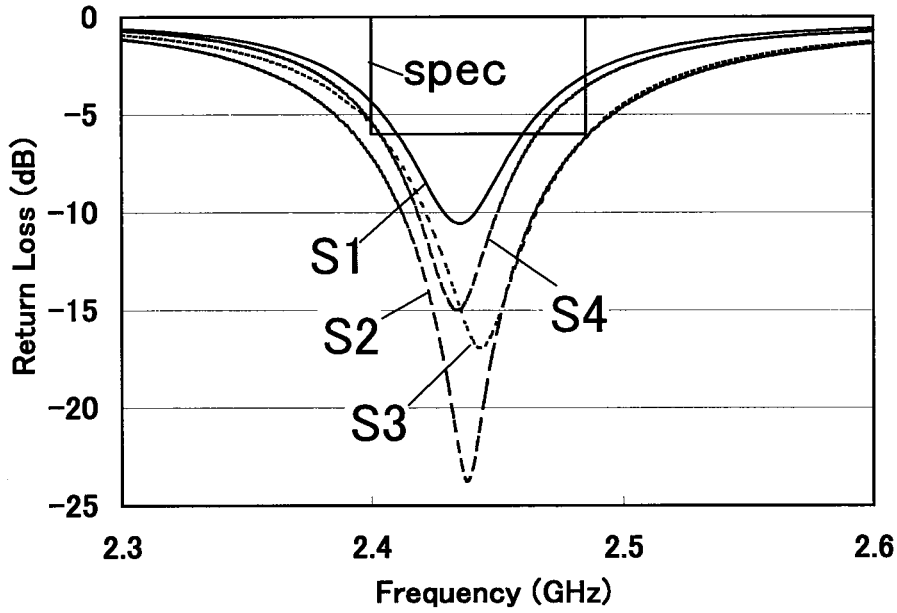
FIGS. 20A and 20B are graphs that show the results of the measurement of the antenna characteristics when altering the position of the antenna mounting area on the printed circuit board, specifically

As shown in FIG. 20A, the return loss of each of the samples S1 to S4 becomes smallest at a frequency in the neighborhood of 2.43 GHz. Particularly, the sample S2 has the smallest return loss, followed by the sample S3, the sample S4, and the sample S1 in this order. Also, the graph shows that only the sample S2 is not included in the region defined by the borderline "spec" that determines whether the requirement for the return loss to be −6 dB or less in a desired frequency band is satisfied. The graph also shows that the sample S3 barely satisfies the requirement.

Figure 20B:
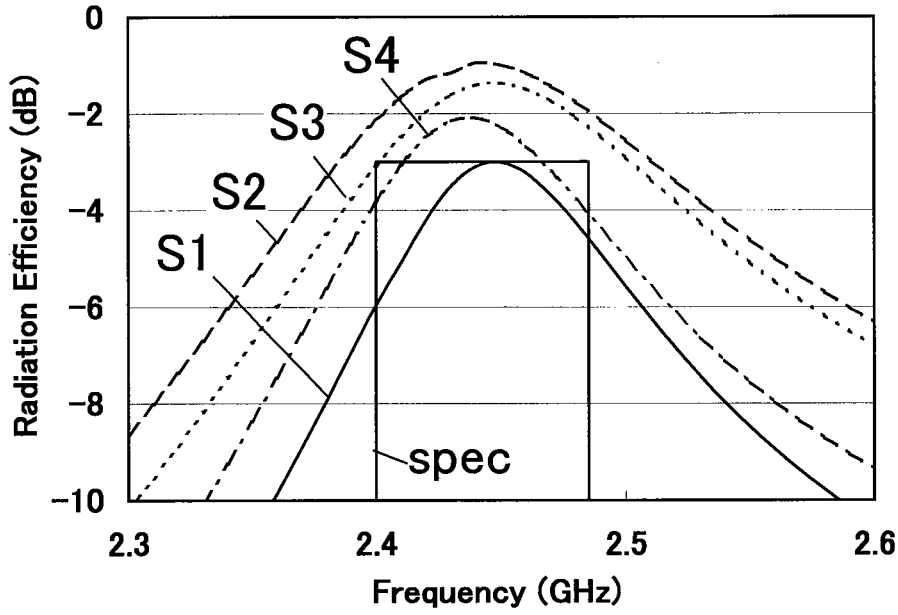

As shown in FIG. 20B, the radiation efficiency of each of the samples S1 to S4 becomes highest at a frequency in the neighborhood of 2.43 GHz. Particularly, the sample S2 has the highest radiation efficiency, followed by the sample S3, the sample S4, and the sample S1 in this order. The graph shows that only the sample S2 is not included in the region defined by the borderline "spec" that determines whether the requirement for the radiation efficiency to be −3 dB (50%) or higher in a desired frequency band is satisfied. The graph also shows that the sample S3 barely satisfies this requirement.

Example 2

The antenna characteristics were measured while the aspect ratio of the antenna mounting region was varied. The size of the printed circuit board was 80 mm×37 mm×1 mm, and the antenna mounting region was located at the reference point (0%) in the longitudinal direction of the printed circuit board. The size (Wa×Wb, as shown in FIG. 3A) of the antenna mounting region was 3 mm×5 mm in a sample S5, 3 mm×4.5 mm in a sample S6, and 3 mm×4 mm in a sample S7. The chip size of the antenna element was 2.0 mm×1.2 mm×1.0 mm, and the relative permittivity $\in_r$ of the base of the antenna element was 37. The conductor patterns on the antenna element were adjusted so that the resonance frequency of each of the samples S5 to S7 became 2.43 GHz, and the input impedance became 50Ω. After that, signals between 2.3 GHz to 2.6 GHz were supplied through a signal line with the use of a network analyzer, and the return loss and radiation efficiency of the antenna device were measured. FIGS. 12A and 12B show the results of the measurement.

Figure 21A:
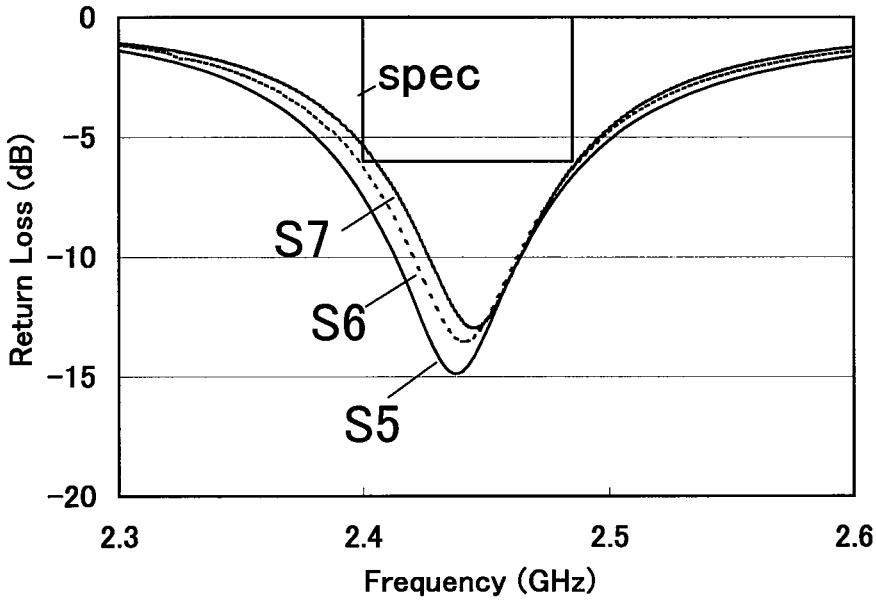
FIGS. 21A and 21B are graphs that show the results of the measurement of the antenna characteristics when altering the aspect ratio of the antenna mounting area, specifically

As shown in FIG. 21A, the return loss of each of the samples S5 to S7 becomes smallest at a frequency in the neighborhood of 2.43 GHz. Particularly, the sample S5 has the smallest return loss, followed by the sample S6 and the sample S7 in this order. Also, the graph shows that the samples S5 and S6 are not included in the region defined by the borderline "spec" that determines whether the requirement for the return loss to be −6 dB or less in a desired frequency band is satisfied. The graph also shows that the sample S7 cannot satisfy the requirement.

Figure 21B:
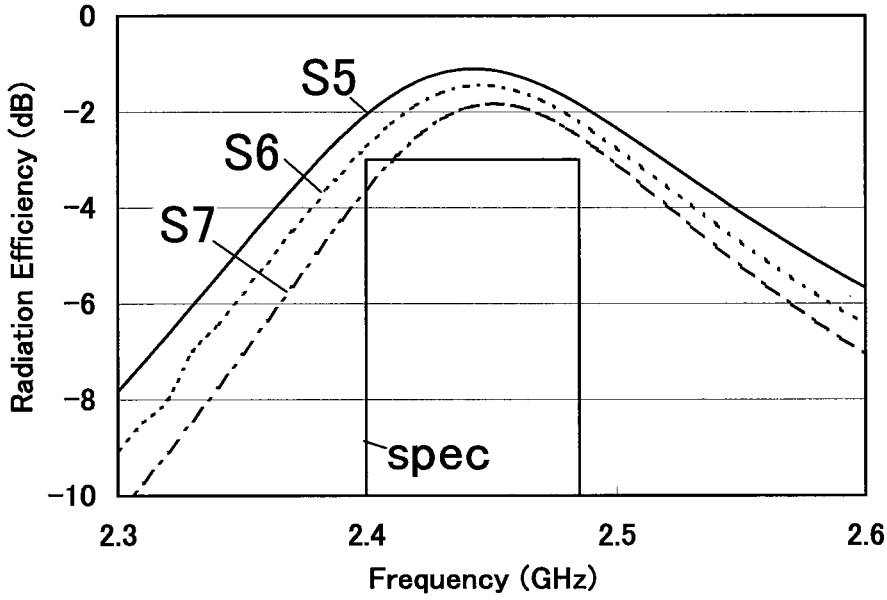

As shown in FIG. 21B, the radiation efficiency of each of the samples S5 to S7 becomes highest at a frequency in the neighborhood of 2.43 GHz. Particularly, the sample S5 has the highest radiation efficiency, followed by the sample S6 and the sample S7 in this order. The graph shows that the samples S5 and S6 are not included in the region defined by the borderline "spec" that determines whether the requirement for the radiation efficiency to be −3 dB (50%) or higher in a desired frequency band is satisfied. The graph also shows that the sample S7 cannot satisfy this requirement.

What is claimed is:

1. An antenna device comprising:

an antenna element; and a printed circuit board on which the antenna element is mounted, wherein the antenna element includes:

a base that is made of dielectric material and has substantially rectangular parallelepiped shape, the substantially rectangular parallelepiped shaped base having a first surface, a second surface opposite to the first surface and facing the printed circuit board, and a third surface between, and perpendicular to, the first surface and the second surface;

a radiation conductor that is formed on the first surface of the base, one end of the radiation conductor being an open end; and a plurality of terminal electrodes formed on the second surface of the base, the printed circuit board includes:

an insulating substrate having a first surface facing the antenna element and a second surface opposite to the first surface;

an antenna mounting region that is a substantially rectangular insulating region on the first surface of the insulating substrate, the antenna mounting region being in contact with an edge of the first surface of the insulating substrate;

a ground pattern that is formed on the first surface of the insulating substrate and defines three sides of the antenna mounting region except a side in contact with the edge of the first surface of the insulating substrate;

a feed line that is led into the antenna mounting region along the edge of the first surface of the insulating substrate; and a ground clearance region that is free of ground patterns, is formed on the second surface of the insulating substrate, and is arranged to overlap the antenna mounting region, a loop conductor of a substantially U-shape is provided in a region where the antenna element overlaps with the printed circuit board, one end of the loop conductor is connected to the feed line, the other end of the loop conductor is connected to the ground pattern, the loop conductor includes a first strip conductor pattern arranged to face a first terminal electrode of the plurality of terminal electrodes via a gap having a predetermined width, the first terminal electrode being connected to the other end of the radiation conductor, the antenna element includes a ground conductor formed on the third surface of the base, the ground conductor being connected between the other end of the radiation conductor and the first terminal electrode, the first terminal electrode is formed on one end portion of the second surface of the base, the one end portion being adjacent to the third surface of the base, the plurality of terminal electrodes further include second and third terminal electrodes formed on the other end portion of the second surface of the base, and the printed circuit board includes first to third lands provided in the antenna mounting region, the first to third lands corresponding to the first to third terminal electrodes, respectively, the first land being connected to the ground pattern, the second land being connected to the feed line, the third land being connected to the ground pattern.

2. The antenna device as claimed in claim 1, wherein the loop conductor is provided entirely in a region where the antenna element overlaps with the printed circuit board, and the other end of the loop conductor is connected to the ground pattern via the third terminal electrode and the third land.

3. The antenna device as claimed in claim 2, wherein the loop conductor further includes second and third strip conductor patterns parallel to the edge of the first surface of the insulating substrate, one end of the second strip conductor pattern is connected to the second land through the second terminal electrode, the other end of the second strip conductor pattern is connected to one end of the first strip conductor pattern, one end of the third strip conductor pattern is connected to the third land through the third terminal electrode, and the other end of the third strip conductor pattern is connected to the other end of the first strip conductor pattern.

4. The antenna device as claimed in claim 3 further comprising a frequency adjustment pattern, formed in the antenna mounting region, for adjusting a resonance frequency, wherein the frequency adjustment pattern is a fourth strip conductor pattern extending from a substantially longitudinal central portion of the first strip conductor pattern.

5. The antenna device as claimed in claim 3 further including an impedance adjustment pattern, formed in the antenna mounting region, for adjusting impedance of the loop conductor, wherein the impedance adjustment pattern is a fourth strip conductor pattern provided in parallel to the first strip conductor pattern so as to make a loop size of the loop conductor small.

6. The antenna device as claimed in claim 1, wherein the first strip conductor pattern includes a meander pattern.

7. The antenna device as claimed in claim 1, wherein the loop conductor includes:

a through-hole conductor that penetrates the insulating substrate; and a second strip conductor pattern formed on the second surface of the insulating substrate, wherein one end of the through-hole conductor is connected to the other end of the loop conductor, and the other end of the through-hole conductor is connected to a ground pattern formed on the second surface of the insulating substrate via the second strip conductor pattern.

8. The antenna device as claimed in claim 1, wherein the ground clearance region is substantially in a rectangular shape having long sides and short sides, and when an edge of one long side is evenly divided into four to define first to fourth edge portions arranged from one end of the edge of the one long side to the other end thereof in that order, the antenna mounting region is placed to contact at least one of the second edge and the third edge.

9. The antenna device as claimed in claim 1, wherein the ground clearance region is substantially in a rectangular shape having long sides and short sides, the printed circuit board is substantially in a rectangular shape having long sides and short sides, the long sides of the ground clearance region extends in a direction perpendicular to the long sides of the printed circuit board, and the aspect ratio of the ground clearance region is 1.5 or higher.

10. The antenna device as claimed in claim 1, wherein the antenna element is mounted on the printed circuit board so as to cause short-circuit between one ground part and the other ground part defining two opposing sides of the antenna mounting region.

11. The antenna device as claimed in claim 1, wherein the insulating substrate is a multiplayer substrate, an inner layer of which has another ground clearance region overlapping the antenna mounting region.

12. An antenna element comprising:

a base that is made of dielectric material and has substantially rectangular parallelepiped shape, the substantially rectangular parallelepiped shaped base having a first surface, a second surface opposite to the first surface, and a third surface between, and perpendicular to, the first surface and the second surface;

a radiation conductor that is formed on the first surface of the base, one end of the radiation conductor being an open end;

a ground conductor that is formed on the third surface of the base, the ground conductor being connected to the other end of the radiation conductor;

a first terminal electrode that is formed on one end portion of the second surface of the base and is connected to the ground conductor, the one end portion being adjacent to the third surface of the base; and a loop conductor of a substantially U-shape that is formed on the second surface of the base, wherein the loop conductor includes a first strip conductor pattern arranged to face the first terminal electrode via a gap having a predetermined width, one end of the loop conductor is for feeding, and the other end of the loop conductor is for grounding.

13. The antenna element as claimed in claim 12, further comprising a second terminal electrode for feeding and a third terminal electrode for grounding, the second and third terminal electrodes being formed on the other end portion of the second surface of the base, wherein the loop conductor further includes second and third strip conductor patterns parallel to each other, one end of the second strip conductor pattern is connected to the second terminal electrode, the other end of the second strip conductor pattern is connected to one end of the first strip conductor pattern, one end of the third strip conductor pattern is connected to the third terminal electrode, and the other end of the third strip conductor pattern is connected to the other end of the first strip conductor pattern.

14. The antenna element as claimed in claim 13, wherein the antenna device further includes a frequency adjustment pattern for adjusting a resonance frequency, and the frequency adjustment pattern is a fourth strip conductor pattern arranged between, and parallel to, the second strip conductor and the third strip conductor, one end of the frequency adjustment pattern is connected to the first strip conductor pattern.

15. The antenna element as claimed in claim 12, wherein the first strip conductor pattern includes a meander pattern.

* * * * *